US006361110B2

(12) United States Patent
Roslund, Jr. et al.

(10) Patent No.: US 6,361,110 B2
(45) Date of Patent: Mar. 26, 2002

(54) TILT CONTROL FOR CHAIR

(75) Inventors: Richard N. Roslund, Jr., Jenison; Patrick Nelson, Holland; Larry Allen Wilkerson, Comstock Park; Troy Roark, West Olive, all of MI (US); Joel Dral, Lula, GA (US); Steve Simpson; John Clark, both of Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/746,180

(22) Filed: Dec. 21, 2000

Related U.S. Application Data

(60) Division of application No. 09/434,431, filed on Nov. 4, 1999, now Pat. No. 6,286,900, which is a continuation of application No. 09/016,371, filed on Jan. 30, 1998, now Pat. No. 6,015,187, which is a continuation-in-part of application No. 08/846,618, filed on Apr. 30, 1997, now Pat. No. 5,909,924.

(51) Int. Cl.[7] ..... A47C 3/20; A47C 3/30

(52) U.S. Cl. ..... 297/344.19; 297/344.16; 248/161; 248/404; 248/631

(58) Field of Search ..... 297/344.16, 344.17, 297/344.18, 344.19; 248/161, 404, 631

(56) References Cited

U.S. PATENT DOCUMENTS 3,790,119 A * 2/1974 Bauer ..... 248/404
4,756,496 A * 7/1988 Hosan et al. ..... 248/161
5,004,214 A * 4/1991 Marchina ..... 248/631
5,826,935 A * 10/1998 DeFreitas ..... 297/344.19
6,276,756 B1 * 8/2001 Cho et al. ..... 297/344.19

* cited by examiner

*Primary Examiner*—Anthony D. Barfield
(74) *Attorney, Agent, or Firm*—Flynn, Thiel, Boutell & Tanis, P.C.

(57) ABSTRACT

A tilt control mechanism for an office chair includes a spring arrangement which permits forward and rearward tilting of the chair while also urging the chair to a normal upright position. The spring arrangement includes front and rear springs which act in combination such that the upward acting forces acting on the chair can be varied during use. The forces being applied by the front spring are adjusted by a side-actuated tension adjustment mechanism which incorporates a wedge block for adjusting the spring forces. Further, the rear springs provide a variable spring force such that the spring force is maximized when in the normal position but is decreased substantially once the chair is fully reclined. This reduction in spring force allows a user to maintain the chair in the fully reclined position with significantly less force than was required to tilt the chair rearwardly while a sufficient spring force continues to be applied by the front spring to urge the chair to the normal position.

19 Claims, 33 Drawing Sheets

TILT CONTROL FOR CHAIR

This application is a division of Ser. No. 09/434 431 now U.S. Pat. No. 6,286,900, filed Nov. 4, 1999, which is a continuation of Ser. No. 09/016 371, filed Jan. 30, 1998, now U.S. Pat. No. 6,015,187, which is a continuation-in-part of Ser. No. 08/846 618, filed Apr. 30, 1997, now U.S. Pat. No. 5,909,924.

FIELD OF THE INVENTION

This invention relates to an office chair and in particular, to an office chair which includes seat and back assemblies which are tiltable forwardly and rearwardly relative to a chair base.

BACKGROUND OF THE INVENTION

Office chairs have been developed where seat and back assemblies thereof are tiltable forwardly and rearwardly. One type of office chair is commonly referred to as a "synchro-tilt" type chair wherein the back assembly tilts synchronously with respect to the seat assembly but at a greater rate. As a result, the back assembly tilts relative to the seat assembly as the latter tilts relative to a chair base on which the seat and back are supported. Such synchronous tilting is provided by a tilt control mechanism which mounts to the chair base and joins the back assembly to the seat assembly. Numerous control mechanisms have been developed which effect such tilting.

More particularly, these tilt control mechanisms typically include a spring arrangement contained therein which resists the rearward tilting of the seat and back. Preferably, the spring arrangements cooperate with a spring adjustment mechanism so as to adjust the load of the spring which resists the rearward tilting. Thus, the amount of force necessary to tilt the seat rearwardly can be manually adjusted to suit each user.

Typically these spring adjustment mechanisms include handles which project out of the tilt control mechanism housing and are rotatable so as to vary the spring load. While a large number of these adjustment mechanisms use adjustment knobs which project downwardly through the bottom of a control housing, providing the adjustment knobs on the side of the tilt control mechanism is easier to operate since a user need not reach down below the seat.

Examples of tilt control mechanisms having side tension adjustment mechanisms are disclosed in U.S. Pat. Nos. 4,865,384, 4,889,384, 5,106,157, 5,192,114 and 5,385,388.

Accordingly, it is an object of the invention to provide an improved tilt control mechanism for an office-type chair which preferably is a synchro-tilt control. It is a further object that the tilt control mechanism include a side-actuated tension adjustment mechanism which acts upon a spring arrangement to vary the spring force tending to urge the seat assembly to a normal forward position. To optimize the space required for the tilt control mechanism, it is a further object that the control mechanism have a low-profile design wherein a combination of front and rear springs is provided. In view thereof, it is an object of the invention that the tension adjustment mechanism act on either the forward or rearward springs. A still further object is to provide a tilt control mechanism wherein the spring arrangement urges the seat forwardly but provides for a drop-off or dwell in the spring load being applied once the seat reaches a rearward position such that the seat can be readily maintained in the rearward position with less force than was required to move the seat to the rearward position.

In view of the foregoing, the invention relates to a tilt control mechanism for a chair which provides for synchronous tilting of the seat and back assemblies. Preferably the tilt control mechanism is supported on a chair base while the seat assembly and back assembly are joined together by the tilt control mechanism. The tilt control mechanism disclosed herein permits both rearward tilting of the seat relative to the chair base while also permitting a corresponding rearward tilting of the back assembly relative to the seat. The tilting of the back assembly is at a different and preferably greater rate than the rearward tilting of the seat which is commonly referred to as "synchro-tilt". The tilt control mechanism also permits forward tilting of the seat relative to the base to further optimize the comfort of a user.

More particularly, the tilt control mechanism includes a box-like control housing which is rigidly secured to the base. The control housing opens upwardly to define a hollow interior and contains the internal components of the tilt control mechanism.

To effect rearward tilting, the control mechanism includes a seat back support member which is hinged to the control housing by a center pivot rod, screws or the like. The back support member extends rearwardly therefrom to support the back assembly. In particular, the center pivot rod defines a first horizontal pivot axis so as to permit vertical swinging of the back support member about this horizontal pivot axis. The back support member forms a lower generally horizontal leg of an L-shaped back upright which supports the back assembly thereon. Thus, the back assembly tilts rearwardly in response to a corresponding swinging movement of the back support member.

The control mechanism further includes a horizontally enlarged top plate which has a front edge portion pivotally secured to the control housing by a front pivot rod, and a rear edge portion slidably secured to the back support member by a rear pivot rod, screws or other suitable fasteners. In particular, the rear edge portion of the top plate includes horizontally elongate slots which are formed through the side walls thereof and slidably receive the opposite ends of the rear pivot rod therethrough. Unlike the center and front pivot rods which only provide for pivoting movement, the opposite ends of the rear pivot rod project from the back support member and are movable forwardly and rearwardly along the slots formed in the top plate. Preferably, the opposite ends of the rear pivot rod includes bearings or rollers that roll along the slots so as to reduce friction. Thus, while the control housing remains stationary, the top plate and back support member pivot downwardly together but at different rates during rearward tilting of the chair. While this movement is in a downward direction, the rearward tilting of the seat and back occurs. Similarly, upward pivoting of the top plate and back support member effects a forward tilting of the seat and back.

To normally maintain the back assembly in an upright position, the control mechanism includes a front coil spring supported on the front pivot rod, and a pair of rear coil springs supported on the rear pivot rod. These coil springs include lower legs which act downwardly on the stationary control housing and upper legs which act upwardly on the pivotable top plate. The front and rear coil springs thereby urge the top plate as well as the back support member upwardly relative to the stationary control housing. The springs, however, permit rearward tilting of the top plate and the back support member.

The tension being applied by the coil springs is adjusted by a tension adjustment mechanism. The tension adjustment mechanism includes a wedge block which preferably seats underneath the lower legs of the front springs, and a side-actuatable adjustment rod which is movable laterally into and out of the control housing to move the wedge block forwardly. To transform the lateral movement of the rod into the forward movement of the wedge block, the wedge includes an angled groove on a bottom surface thereof which is seated on an elongate track that projects upwardly from the control housing. The track extends at an angle toward the front of the control housing, and the wedge slidably seats on the track such that the wedge block is slidable therealong at an angle relative to the coil springs. Thus, upon sideward movement of the adjustment rod, the wedge block is moved both sidewardly and forwardly as it travels along the angled track wherein the forward movement of the block tends to urge the lower spring legs upwardly and increase the spring force being applied thereby.

To minimize the effects of the sideward movement of the wedge block on the spring legs, an intermediate plate is disposed between an inclined front surface of the wedge block and a lower surface of the spring legs. By providing the intermediate plate, the sideward movement of the wedge block does not tend to urge the spring legs sidewardly as would otherwise occur if the wedge block acted directly on the spring legs. This tension adjustment mechanism thereby permits ready adjustment of the force provided by the front coil springs.

A further aspect of the chair is provided by the rear springs wherein the lower legs of the springs act upon the control housing, and in particular, act upon an arcuate bearing surface that is supported on a rear edge of the control housing. When the top plate is in the normal horizontal position, the lower spring legs tend to act directly downwardly onto the bearing surface which maximizes the spring forces acting upwardly on the top plate. However, as the top plate and back support member pivot downwardly during rearward tilting of the chair, the rear springs also swing downwardly below the height of the control housing which thereby deflects the lower spring legs. In particular, the lower spring legs deflect from a generally horizontal orientation to a steeply inclined position such that the lower spring legs act more on a side of the arcuate bearing surface instead of the top thereof. Since a substantial portion of the force applied by the lower spring leg now acts forwardly instead of downwardly, the upward acting forces provided by the rear springs are significantly reduced so as to define a dwell for a user. Accordingly, once the chair is tilted rearwardly to its rearward position, a significant reduction in the forces applied by the rear springs occurs which makes it easier for a user to maintain the chair in the rearward position.

Other objects and purposes of the invention, and variations thereof, will be apparent upon reading the following specification and inspecting the accompanying drawings.

Figure 1:
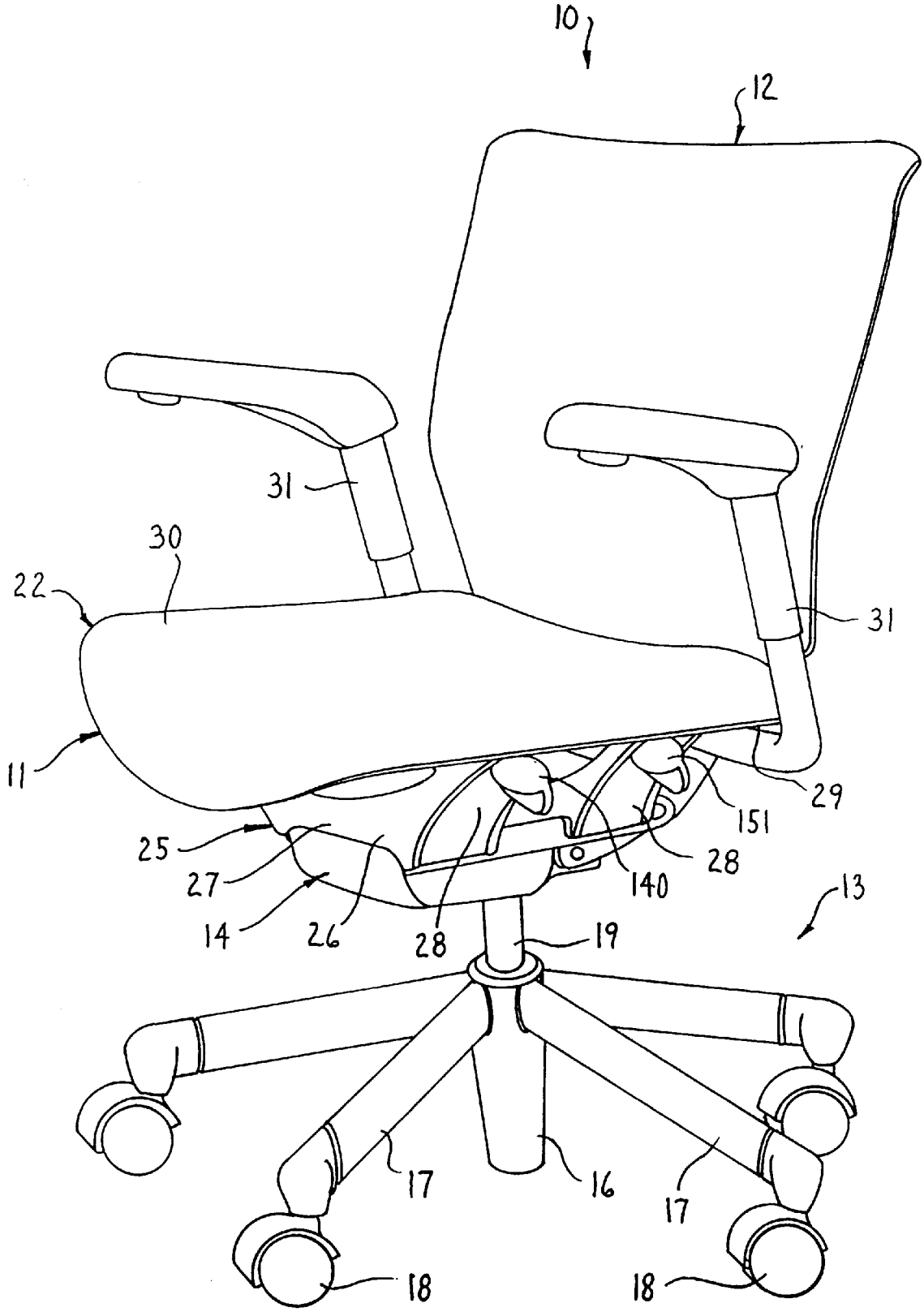
FIG. 1 is a front perspective view of an office chair of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
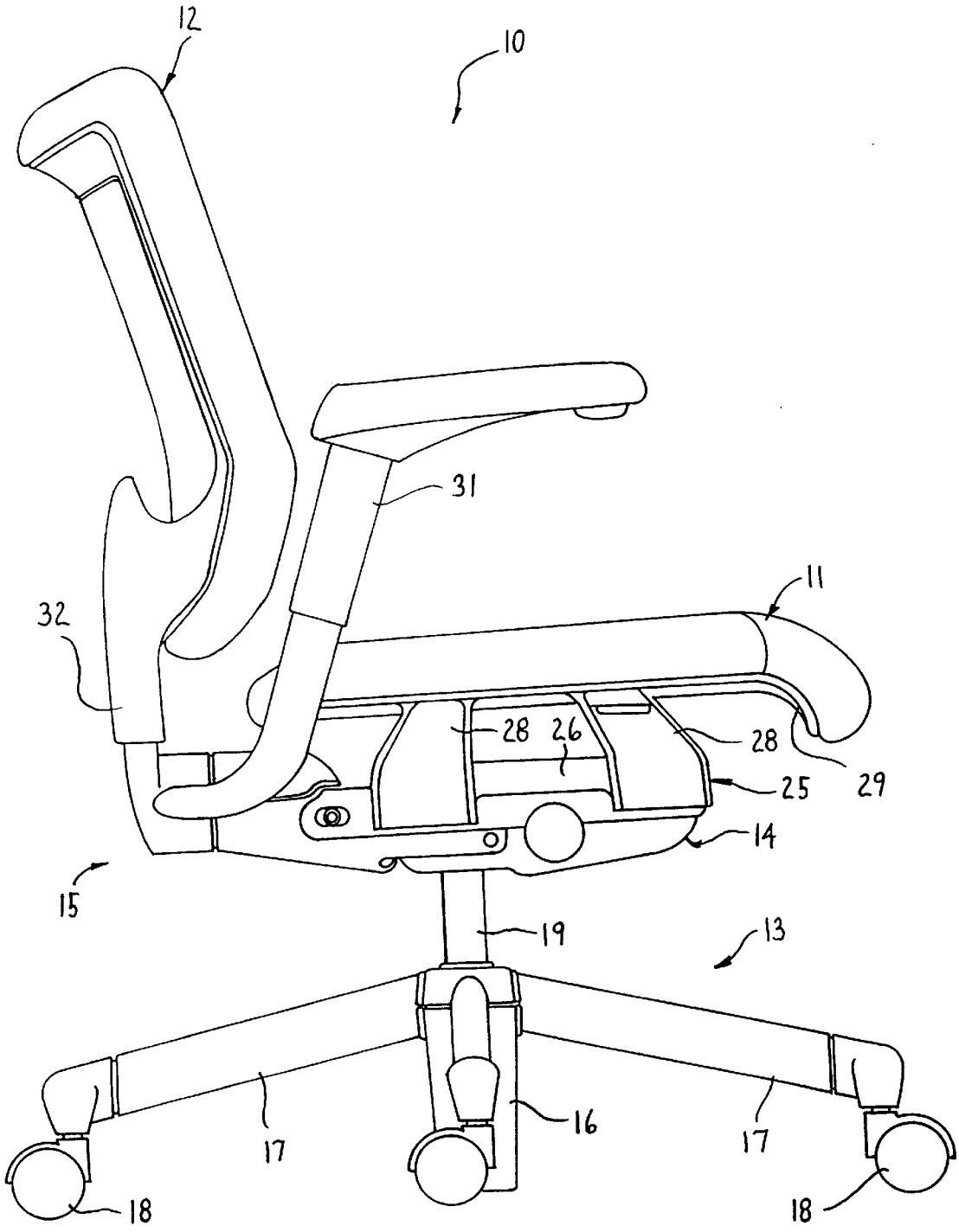
FIG. 2 a side elevational view of the chair.
Figure 3:
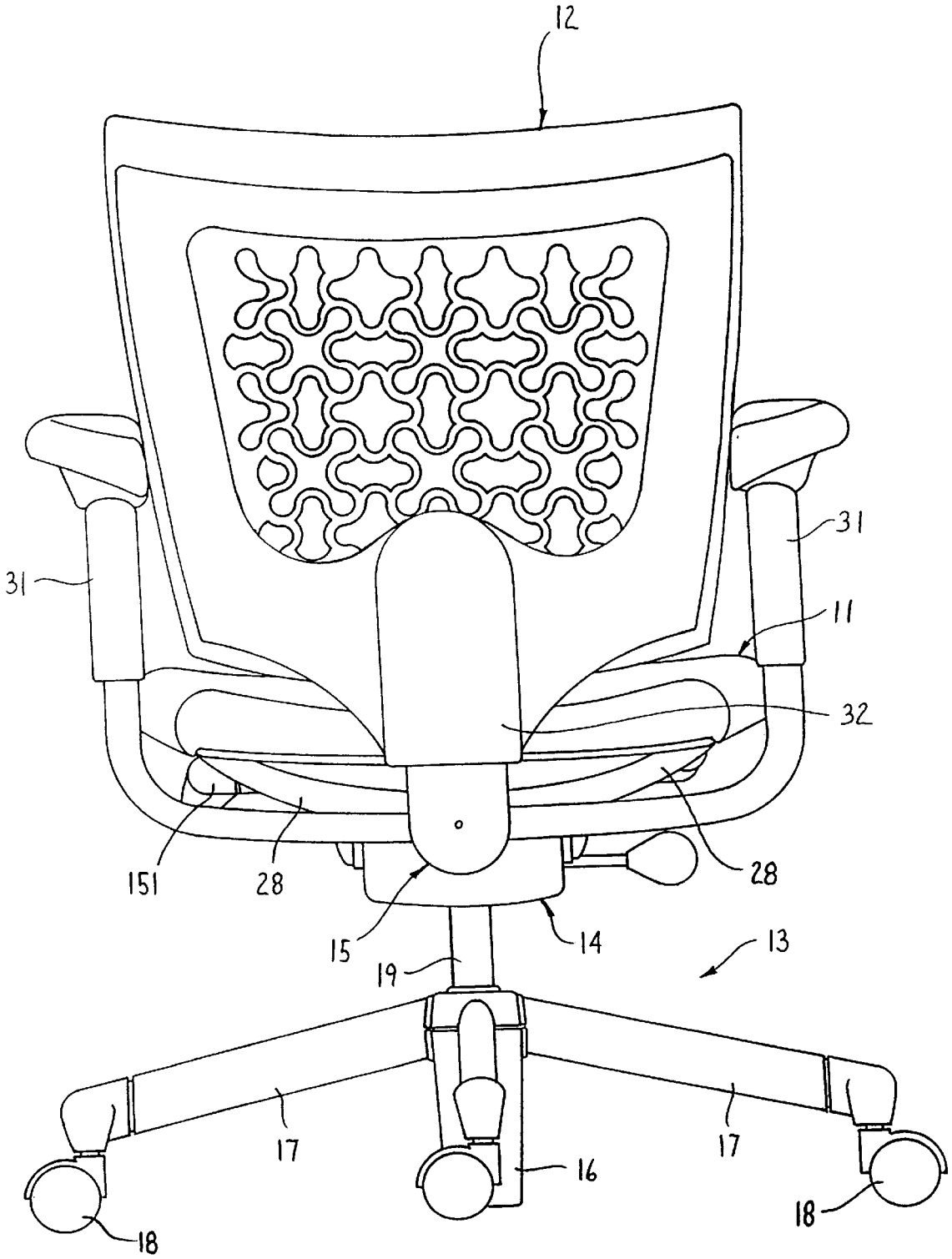
FIG. 3 is a rear elevational view of the chair.
Figure 4:
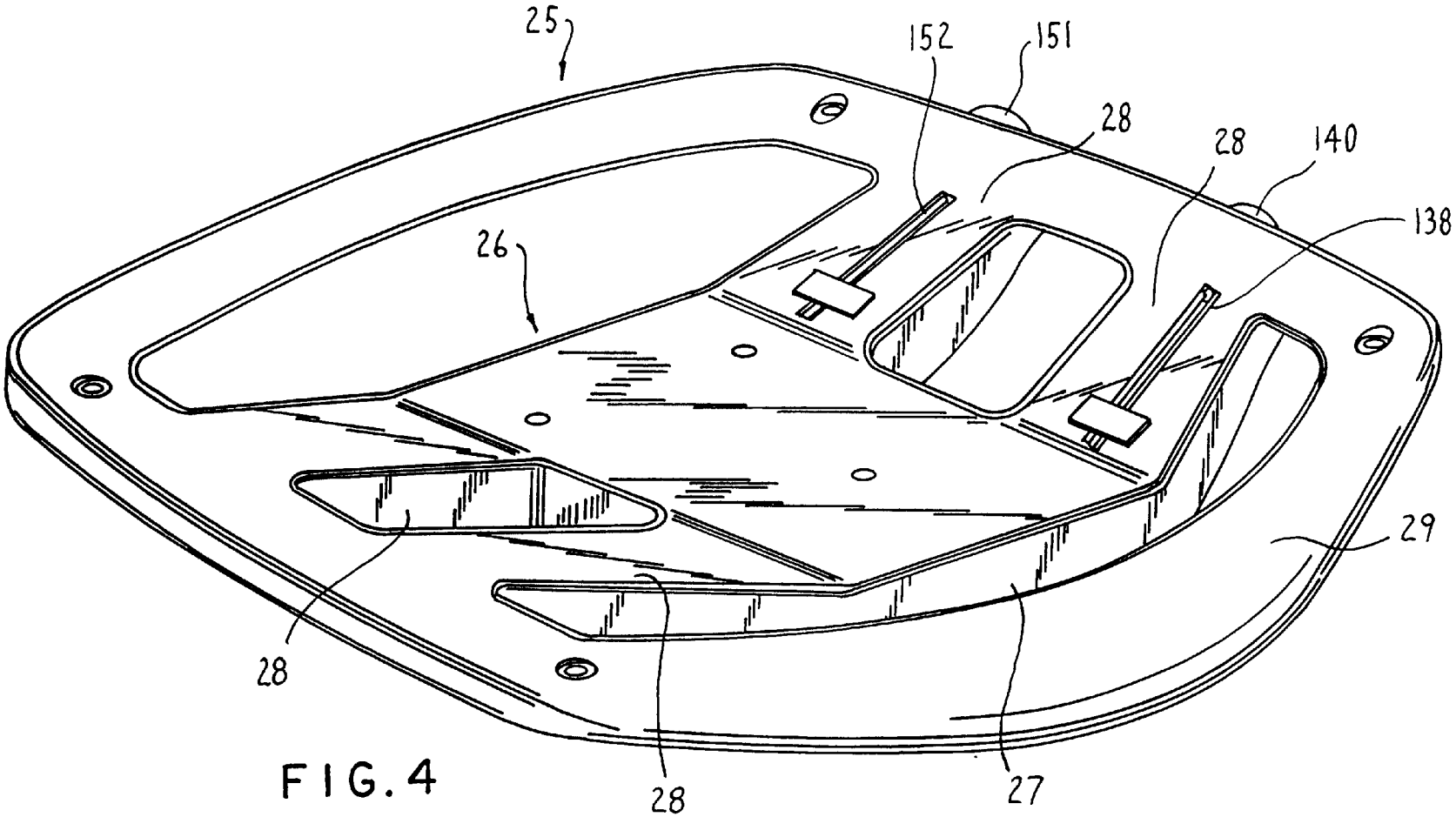
FIG. 4 is an isometric view of a seat support structure.

Referring to FIGS. 1–3, the invention relates to an office-type chair 10 which includes a seat assembly 11 and back assembly 12 which are pivotally supported on a chair base or pedestal 13 to support a user thereon. To increase the comfort of the user, the seat assembly 11 is tiltable forwardly and rearwardly in the direction of arrow A (FIG. 2) by a tilt control mechanism 14 while the back assembly 12 thereof is tiltable laterally from side to side, i.e. in the leftward and rightward directions as indicated by reference arrow B (FIG. 3) by a back torsion mechanism 15.

Generally with respect to the main components of the chair 10, the base 13 is adapted to be supported on a floor and the seat assembly 11 is mounted to the base 13 by the tilt control mechanism 14. The tilt control mechanism 14 thereby permits rearward tilting of the seat assembly 11 relative to the base 14. To improve the comfort of a user, the tilt control mechanism 14 uses a double-spring arrangement which is adjustable as described in more detail hereinafter to urge the chair 10 to a normal upright position.

Further, the back torsion mechanism 15 rigidly joins the back assembly 12 to the seat assembly 11 such that the back assembly 12 pivots rearwardly in response to rearward tilting of the seat assembly 11. At the same time, the back torsion mechanism 15 also defines a forwardly extending horizontal pivot axis whereby the back assembly 12 can be pivoted to the left and right sides. The back torsion mechanism 15 is disclosed in U.S. patent application Ser. No. 08/846 614, entitled CHAIR BACK WITH SIDE TORSIONAL MOVEMENT, filed Apr. 30, 1997 (Atty Ref: Haworth Case 216). The disclosure of this latter application, in its entirety, is incorporated herein by reference. This combination of forward-rearward tilting and torsional movement thereby provides three-dimensional chair movement to increase the comfort of a user.

More particularly with respect to the chair 10 and the tilt control mechanism 14, the chair pedestal 13 includes a central hub 16 and a plurality of pedestal legs 17 which project radially outwardly therefrom. The ends of the pedestal legs 17 include casters 18 which are of conventional construction and support the chair 10 on a floor.

Further, the hub 16 supports a vertically elongate spindle 19 which is movable vertically so as to permit adjustment of the height of the chair 10. The spindle 19 is a rigid upright tube wherein the upper end of the spindle 19 supports a bottom of the seat assembly 11 thereon. The spindle 19 also is formed with a pneumatic cylinder therein of conventional construction which tends to move the upright 19 upwardly relative to the hub 16 to raise and lower the chair height. A normally closed control valve 20 (FIG. 10) is formed at the upper end of the upright 19 which can be opened to permit adjustment of the height of the seat assembly 11.

The seat assembly 11 is supported on the upper end of the spindle 19 by the tilt control mechanism 14 which provides for forward and rearward tilting of the chair 10. To support the seat of a user, the seat assembly 11 further includes a cushion assembly 22 which is supported on the tilt control mechanism 14.

The cushion assembly 22 includes a seat support frame 25 (FIGS. 1–4) which mounts to the tilt control mechanism 14. In particular, the seat support frame 25 is supported on the tilt control mechanism 14 by a rectangular center mounting structure 26 which includes a downwardly depending peripheral side wall 27 that is adapted to be fitted over the top of the tilt control mechanism 14. The center mounting structure 26 thereafter is secured to the top of the control mechanism 14 by suitable fasteners.

The seat support frame 25 further includes four support arms 28 which project sidewardly away from the left and right sides of the center mounting structure 26 and extend generally upwardly to support a ring-like rim 29 a predetermined distance above the control mechanism 14. The ring-like rim 29 has a generally annular shape and is open in the central region above the center mounting structure 26. The peripheral rim 29 is adapted to support a horizontally enlarged plastic inner shell (not illustrated) which overlies the open area of the peripheral rim 29 and includes a resiliently flexible membrane in the central region thereof to provide support to a cushion 30 which is attached thereto. The seat and back assemblies 11 and 12 are disclosed in U.S. patent application Ser. No. 08/846 616, entitled MEMBRANE CHAIR, filed Apr. 30, 1997 (Atty Ref: Haworth Case 215). The disclosure of this latter application, in its entirety, is incorporated herein by reference.

The back assembly 12 also supports a pair of chair arms 31 which project sidewardly and upwardly from a hub 32 on the lower end of the back assembly 12. The hub 32 is connected to the tilt control mechanism 14 by the back torsion mechanism 15.

Generally with respect to the tilt control mechanism 14, these types of mechanisms are used to mount a seat assembly to a chair base and permit rearward tilting of the chair relative to the base. The particular tilt control mechanism 14 (FIGS. 5–7) disclosed herein permits both rearward tilting of the seat 11 relative to the pedestal 13 about a first horizontal pivot axis P1 while also permitting a corresponding rearward tilting of the back assembly 12 relative to the seat about a second horizontal pivot axis P2. Preferably the tilting of the back assembly 12 is at a different and preferably greater rate than the rearward tilting of the seat assembly 11 in the direction of arrow A which arrangement is commonly referred to as a "synchro-tilt" mechanism. The tilt control mechanism 21 also permits forward tilting of the seat 11 relative to the base 13 to further optimize the comfort of a user.

The tilt control mechanism 14 includes a box-like control housing 34 which is rigidly secured to the base 13 and opens upwardly to define a hollow interior. The hollow interior is adapted to contain the internal components of the tilt control mechanism 14 as described in more detail hereinafter. Generally, the interior of the control housing 34 includes a pedestal mounting bracket 35 proximate the rear edge thereof which mounts the control housing 34 to the upper end of the spindle 19. Preferably, the pedestal mounting bracket 35 also permits swivelling of the chair 10 about a vertical axis.

The control mechanism 14 effectively defines a linkage which causes the synchronous tilting of the seat and back assemblies 11 and 12. In particular, the control mechanism 14 includes a seat back support member 36 which is hinged to the control housing 34 by a center or intermediate pivot rod 37. The center pivot rod 37 defines the second horizontal pivot axis P2 and extends sidewardly so as to permit vertical swinging of the back support member 36. Alternatively, screws or other suitable fasteners could be used in place of the rod 37.

The control mechanism 14 further includes a top plate 39 which has a front edge pivotally secured to the front of the control housing 34 by a front pivot rod 40, and a rear edge portion slidably secured to the back support member 36 by a rear pivot rod 41. The front and rear pivot rods 40 and 41 also are oriented horizontally and extend sidewardly, and the front pivot rod 40 defines the first pivot axis P1 about which the top plate 39 pivots. While the control housing 34 remains stationary during use, the top plate 39 and back support member 36 are joined one with the other so as to pivot downwardly together during rearward tilting of the chair 10.

To urge the top plate 39 upwardly and maintain the seat and back assemblies 11 and 12 in the normal position illustrated in FIGS. 1–3, the control mechanism 14 also includes a front coil spring 42 which is supported on the front pivot rod 40, and a pair of rear coil springs 43 which are supported on the rear pivot rod 41. The front coil spring 42 acts downwardly on the control housing 34 and acts upwardly on the top plate 39 so as to resist downward pivoting of the top plate 39. The rear coil springs 43 similarly urge the top plate 39 upwardly so as to assist the front spring 42. The front and rear coil springs 42 and 43 thereby combine to urge the top plate 39 upwardly and tend to maintain the back assembly 12 in the vertically upright position as will be discussed in more detail hereinafter.

The tilt control mechanism 14 also generally includes a tension adjustment mechanism 46 which is actuatable from the side of the control housing 34 by the adjustment knob 47 that projects therefrom. The upward force acting on the top plate 39 thereby can be adjusted so as to make it easier or harder to tilt the seat and back assemblies 11 and 12.

More particularly, with respect to the components of the tilt control mechanism 14, the control housing 34 (FIGS. 10–13) is formed with a bottom wall 51, front wall 52, opposite side walls 53 and a rear wall 54. The front wall 52, side walls 53 and rear wall 54 extend upwardly from the bottom wall 51 so as to define the upward-opening hollow interior thereof.

To support the control housing 34 on the spindle 19, the bottom wall 51 includes an aperture 56 near the rearward end thereof which receives the upper end of the spindle 19 therethrough. The mounting bracket 35 is mounted to the bottom wall 51 to further support the spindle 19. The mounting bracket 35 has a generally U-shape defined by downwardly extending legs 57 which are welded to the housing bottom 51, and a top wall 58 which overlies the aperture 56 formed in the bottom wall 51. The top wall 58 includes a further aperture 59 which is coaxially aligned with the aperture 56 such that the upper end of the spindle 19 is fixedly secured to the mounting bracket 35 by any suitable fastening method such as by welding or a friction fit.

Figure 10:
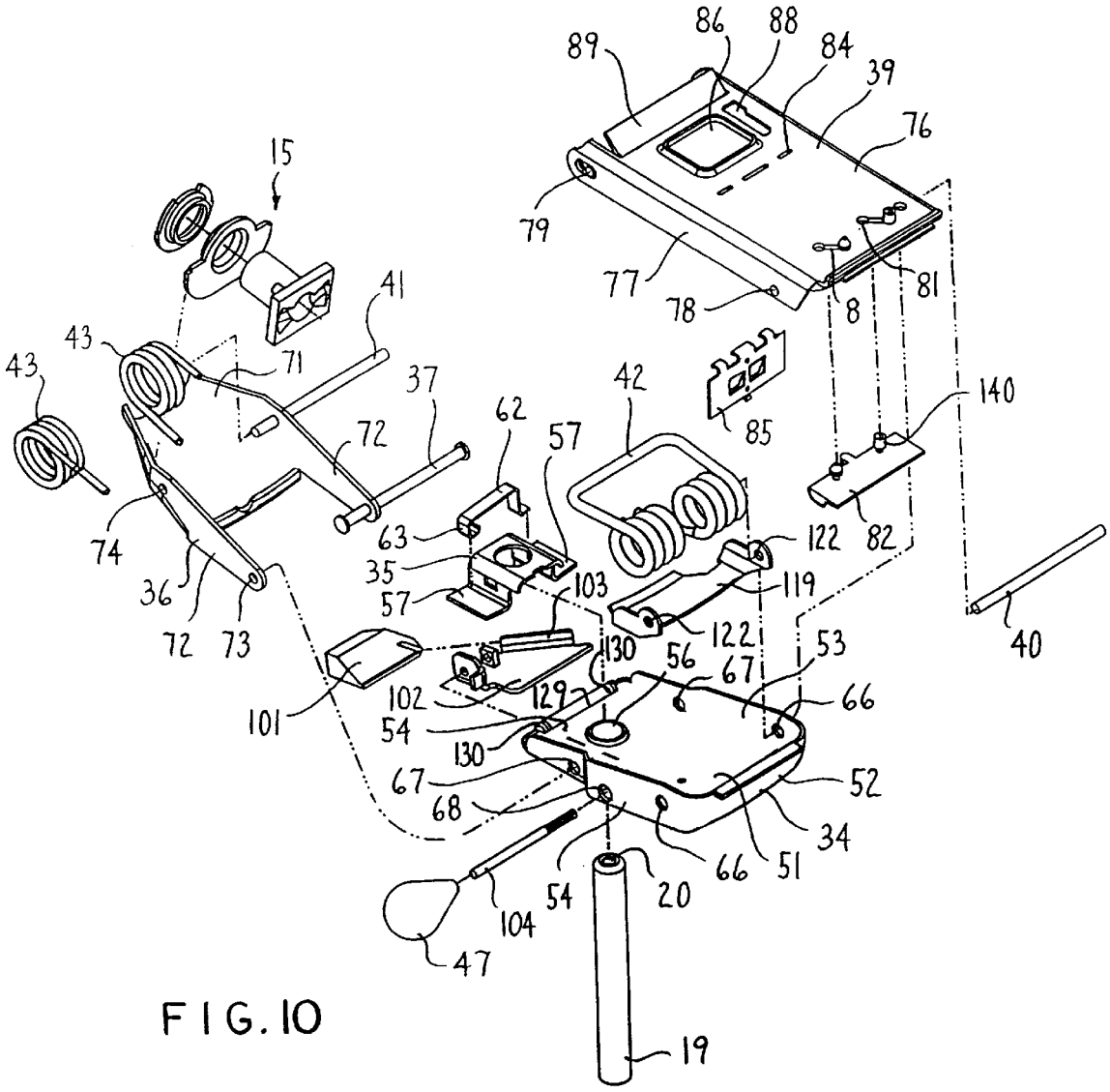
FIG. 10 is an exploded view of the tilt control mechanism.
Figure 11:
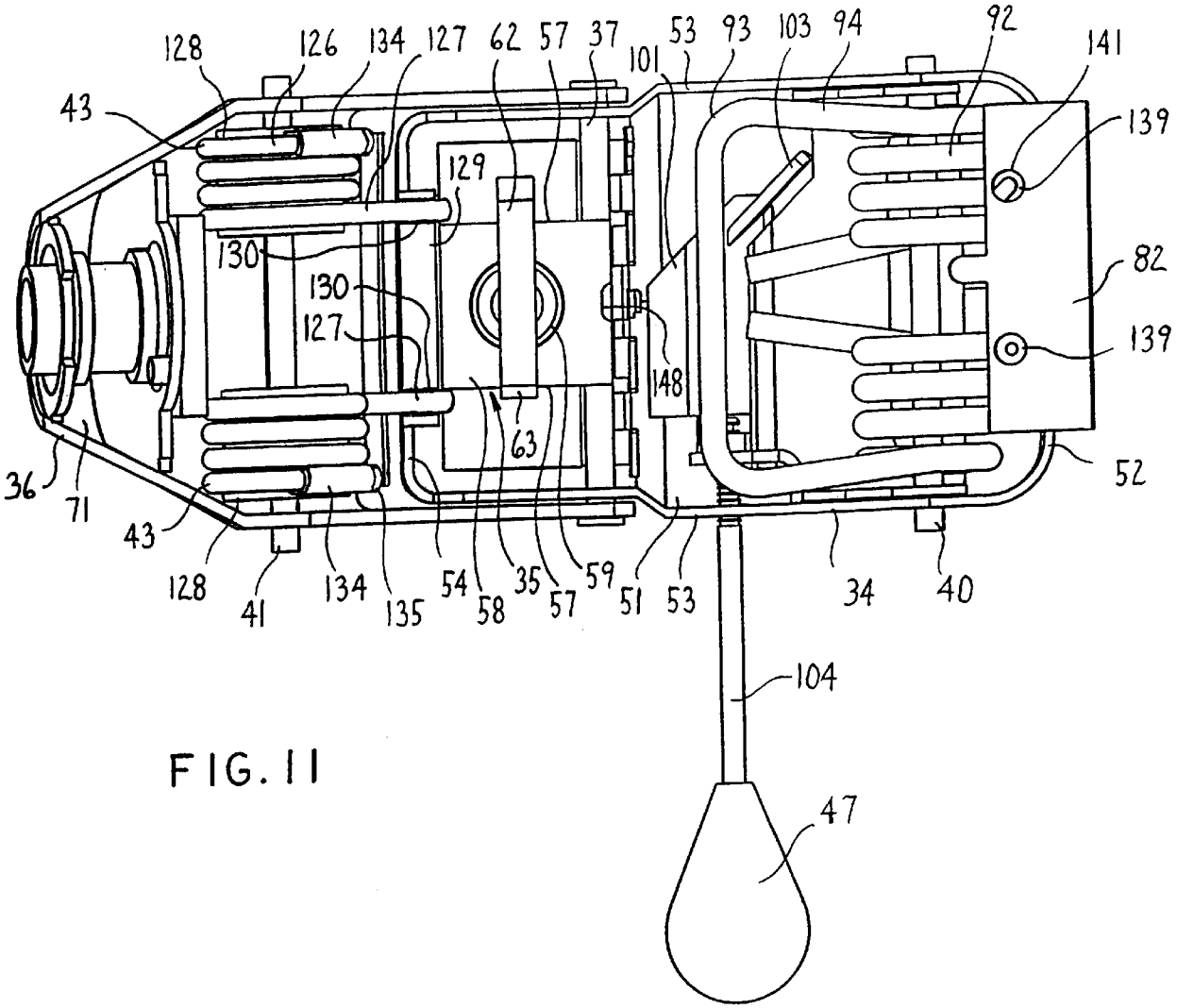
FIG. 11 is a top plan view of the tilt control mechanism with a top plate removed.
Figure 13:
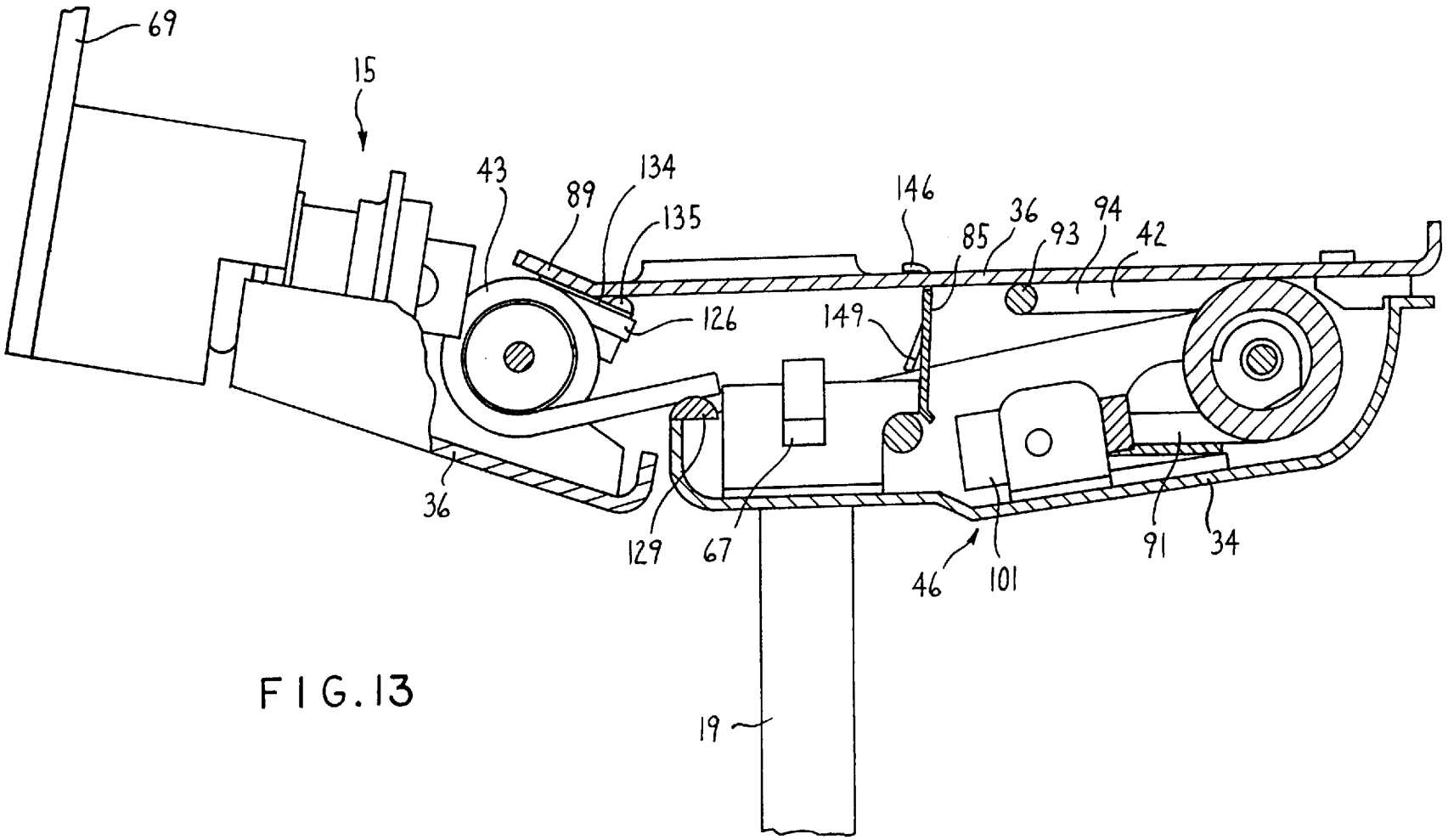
FIG. 13 is a partial side elevational view in partial cross section illustrating the tilt control mechanism as viewed in the direction of arrows 13—13 in FIG. 14.

Referring to FIGS. 10, 11 and 13, the aperture 59 also provides access to the pneumatic control valve 20 of the spindle 19. To actuate the pneumatic cylinder within the spindle 19, the vertical legs 57 of the mounting bracket 35 include openings 61 on the opposite sides thereof. An actuation bracket or lever 62 is provided which has a hooked end 63 which engages one of the openings 61 such that the lever 62 extends over the aperture 59 and is movable upwardly and downwardly. The opposite end of the lever 62 includes a downward leg which moves vertically. While the remaining components for actuating the lever 62 have been omitted from FIG. 10 for the sake of clarity and are not required for an understanding of the invention disclosed herein, the lever 62 is adapted to open the control valve 20 in response to downward pivoting of the lever 62 which thereby permits adjustment of the seat height.

To join the top plate 39 and back support member 36 to the control housing 34 as generally described above, the opposite side walls 53 of the control housing 34 include front apertures 66 and rear apertures 67. The front apertures 66 receive the front pivot rod 40 for connecting the top plate 39 thereto, while the rear apertures 67 receive the center pivot rod 37 for connecting the back support member 36 thereto. The left side wall 53 further includes a middle aperture 68 for the adjustment knob 47.

To support the back assembly 12 on the control housing 34, the back support member 36 includes an upward-opening rearward end section 71 to which the back assembly 12 is connected by the back torsion mechanism 15. In particular, the back assembly 12 includes a rigid vertical upright 69 and the back torsion mechanism 15 rigidly connects the lower end of the upright 69 to the back support member 36. As a result, the upright 69 moves in combination with the back support member 36 while the back torsion mechanism 15 permits sideward tilting of the upright 69 and in particular, sideward tilting of the back assembly 12 which is supported by the upright 69.

The back support member 36 also includes a pair of pivot arms 72 which project forwardly from the rearward end section 71 and are pivotally secured to the side walls 53 of the control housing 34 by the intermediate pivot rod 37. The pivot arms 71 include coaxially aligned apertures 73 at the forward ends thereof which are supported on the center pivot rod 37.

Figure 5:
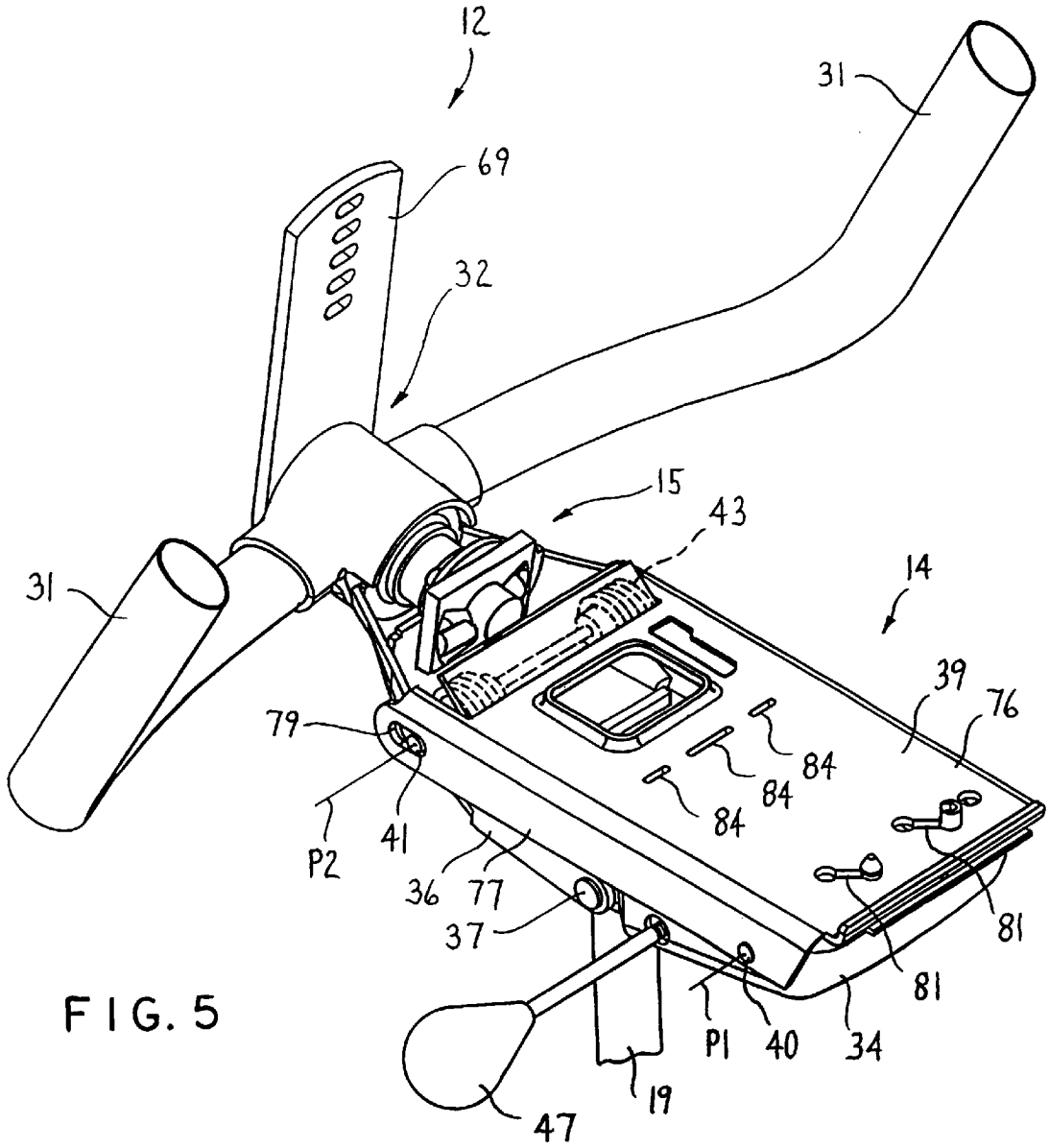
FIG. 5 is a partial perspective view of a tilt control mechanism and an upright assembly supported thereby.
Figure 6:
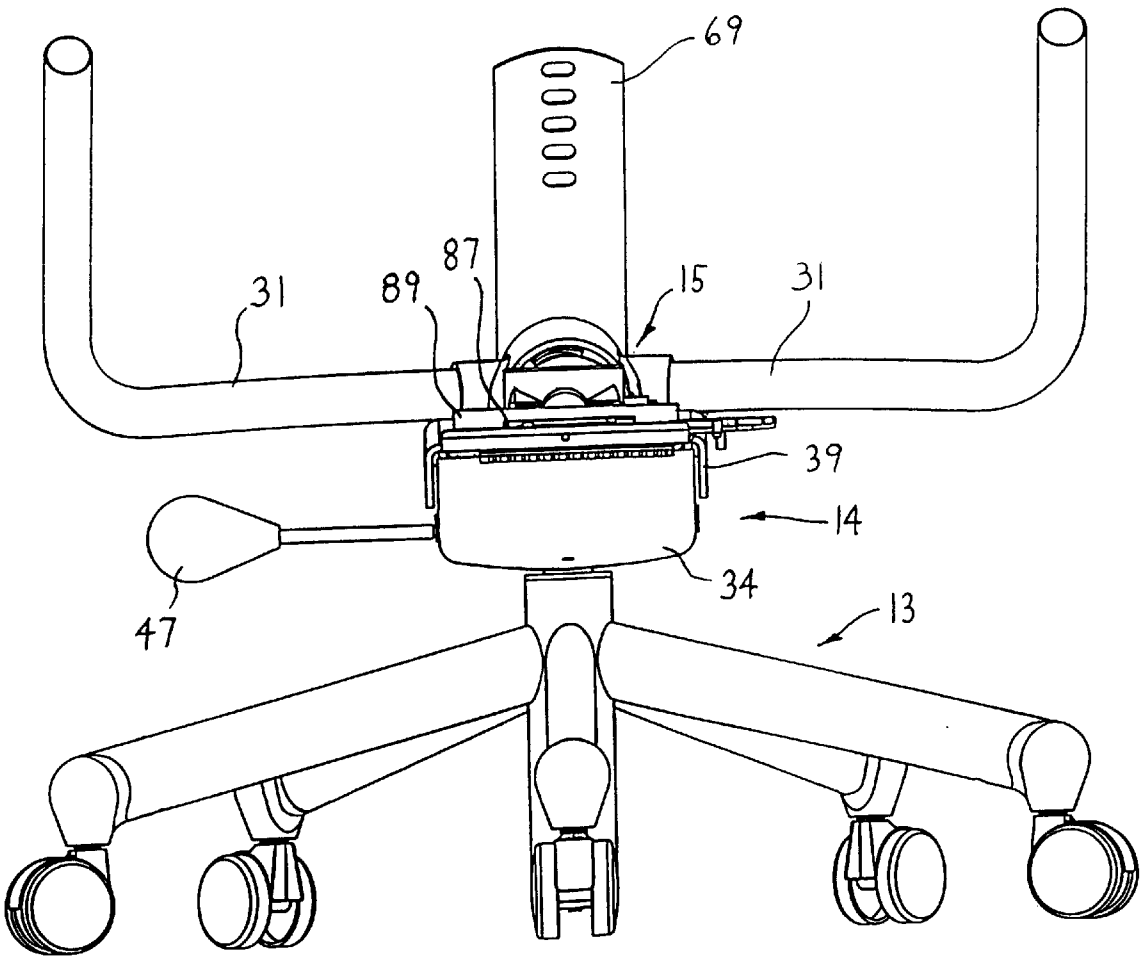
FIG. 6 is a partial front elevational view of the chair.

More particularly, the center pivot rod 37 extends sidewardly or laterally through the aligned apertures 67 and 73 formed in the side walls 53 and pivot arms 72 respectively. As a result, the center pivot rod 37 defines the second horizontal pivot axis P2 such that the back support member 36 moves vertically or pivots in the direction of reference arrows C (FIG. 5).

To connect the top plate 39 to the back support member 36, the rearward end section 71 also includes coaxially aligned apertures 74 formed through the side walls thereof. The apertures 74 receive the rear pivot rod 41 therethrough to connect the top plate 39 and back support member 36 together as described in more detail hereinafter.

Figure 14:
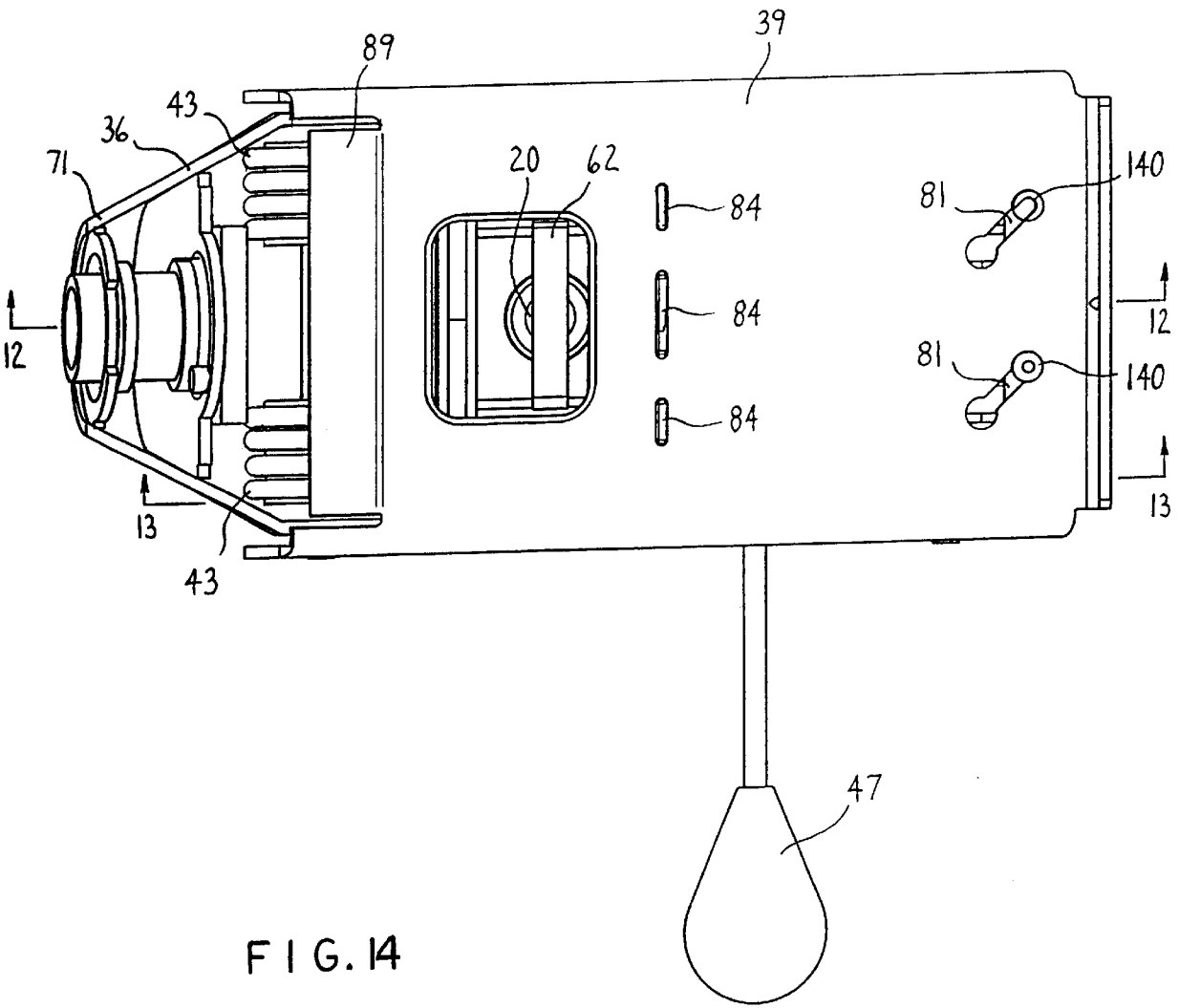
FIG. 14 is a top plan view of the tilt control mechanism.

The top plate 39 (FIGS. 10 and 14) includes a horizontal top wall 76 and downwardly extending side walls 77 so as to seat over the control housing 34 and a portion of the back support member 36. The side walls 77 also include a pair of coaxially aligned front apertures 78 which receive the front pivot rod 40 therethrough. As a result, the front section of the side walls 77 is secured to the housing 34 by the front pivot rod 40 which permits vertical pivoting of the top plate 39 generally in the direction of reference arrow D (FIG. 5) about the pivot axis P1. This vertical pivoting of the top plate 39 permits corresponding tilting of the seat assembly 11 which is connected thereto.

The rear section of the side walls 77 also includes horizontally elongate slots 79 through which the opposite ends of the rear pivot rod 41 project. Thus, unlike the center and front pivot rods 37 and 40 respectively which only permit pivoting movement, the rear pivot rod 41 is slidable along the slots.79 generally in the direction of reference arrow E. In particular, the slots 79 permit both rotational and translational movement of the rear pivot rod 41.

Once the control housing 34, back support member 36 and top plate 39 are pinned together by the center, front and rear pivot rods 37, 40 and 41 as described above, vertical pivoting of the top plate 39 about axis P1 causes a corresponding vertical pivoting of the back support member 36 about axis P2. This vertical pivoting of the back support member 36 thereby results in the forward and rearward tilting of the back assembly 12 which projects upwardly therefrom.

Figure 7:
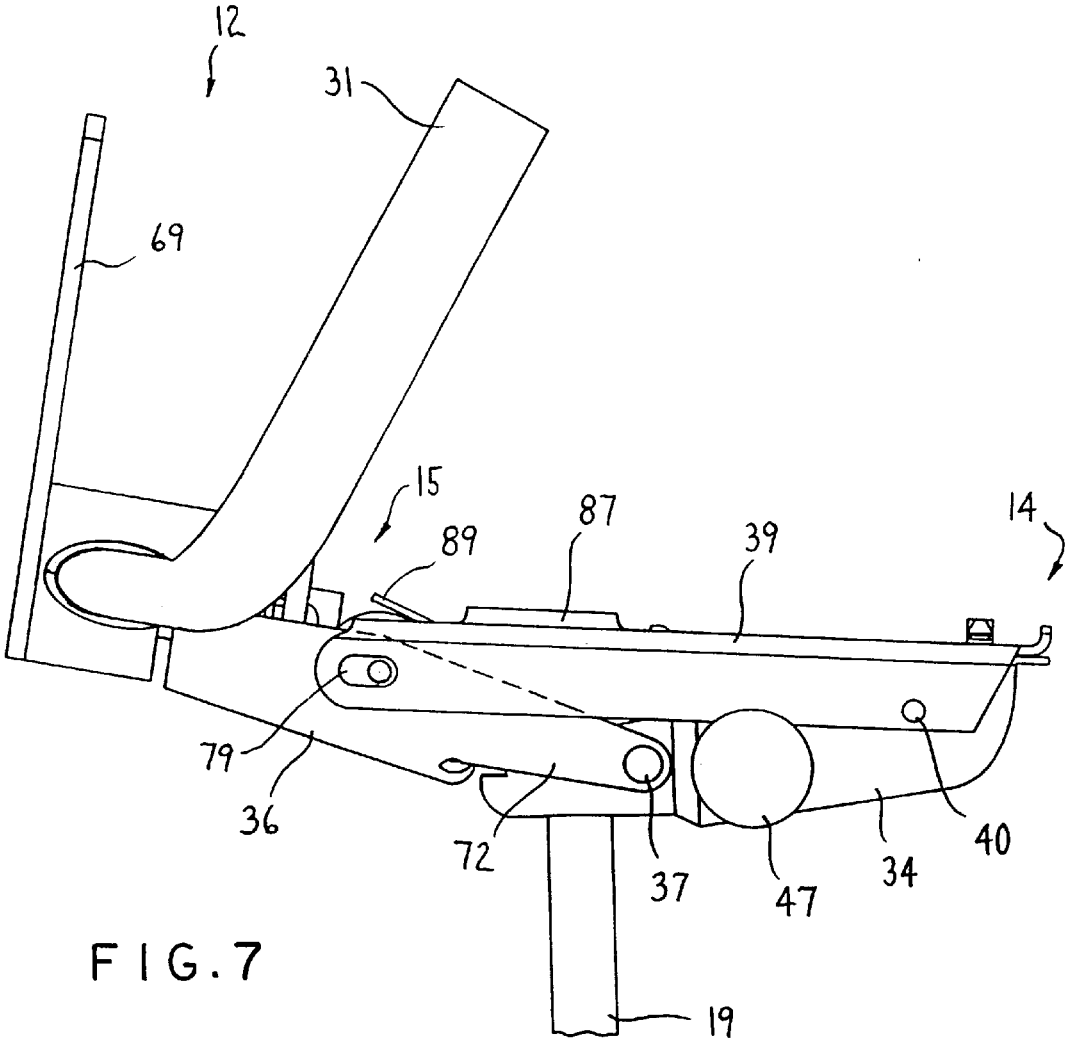
FIG. 7 is a partial side elevational view of the tilt control mechanism illustrated in a forwardly tilted position.
Figure 8:
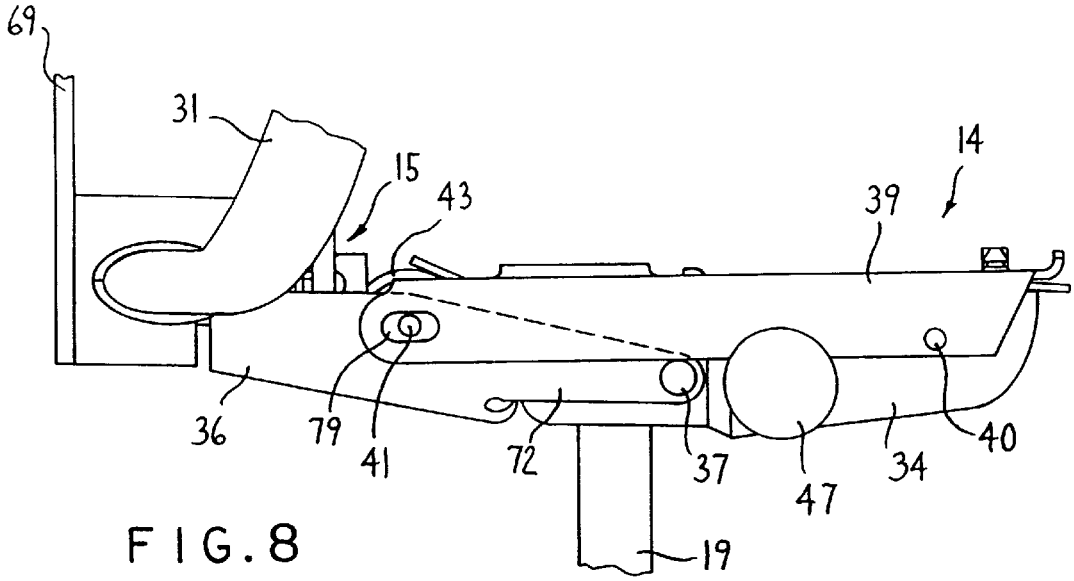
FIG. 8 is a partial side elevational view of the tilt control mechanism illustrated in a normal generally horizontal position.
Figure 9:
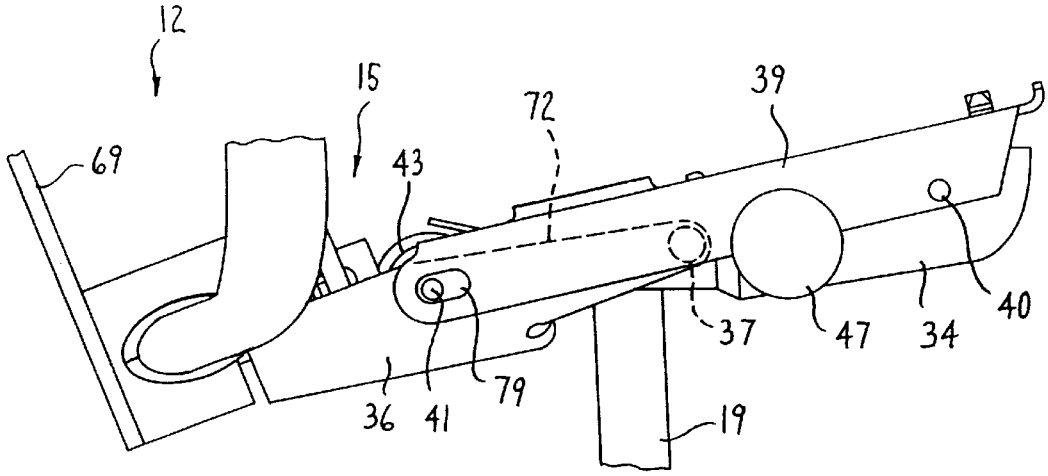
FIG. 9 is a partial side elevational view of the tilt control mechanism illustrated in a rearwardly tilted position.

During use, as seen in FIGS. 7–9, the top plate 39 is pivotable by a user between a forwardly inclined position (FIG. 7) and a rearwardly declined or tilted position (FIG. 9). In the forwardmost position, the rear pivot rod 41 slides forwardly to a front end of the slots 79. In this forward position, the top plate 39 is inclined at an angle of approximately 3° relative to a horizontal plane while the back upright 69 is tilted forwardly of a vertical plane at an angle of 10°. Since the rear pivot rod 41 is able to slide along the length of the slot 79, the top plate 39 can be rearwardly pivoted to a normal seating position illustrated in FIG. 8. In this normal position, the rear pivot rod 41 is disposed generally at the midpoint of the elongate slot 79 wherein the top plate 39 preferably is reclined at an angle of approximately 2° relative to the horizontal plane and the upright 69 is tilted rearwardly of the vertical plane at an angle of 0°. Upon further rearward pivoting of the top plate 39, the rear pivot rod 41 moves to the rearward end of the slot 79. In this rearward position, the top plate 39 preferably is reclined at an angle of approximately −12° relative to the horizontal plane while the upright 69 is at 20°.

As can be seen, the back assembly 12 pivots rearwardly as the top plate 39 pivots. However, the back support member 36 and accordingly, the back assembly 12 which is connected to this back support member 36 tilts rearwardly at a greater rate than the top plate 39. This tilting of the top plate 39 and back support member 36 at different rates is commonly referred to as synchronous tilting or in other words, the tilt control mechanism 14 is referred to as a "synchro-tilt" mechanism. Preferably, the tilt differential between the top plate 39 and back support member 36 is approximately a two-to-one ratio wherein as the top plate 39 tilts rearwardly or downwardly 5°, the back upright 69 pivots rearwardly approximately 10°.

The top wall 76 (FIGS. 10 and 14) also includes a pair of angled slots 81 near the front edge thereof which are adapted to support a front tilt lock plate 82 as will be described in more detail hereinafter. The angled slots 81 preferably have one end which is enlarged similar to a keyhole shape for engagement with the front tilt lock plate 82.

In the middle region of the top wall 76, three sidewardly elongate slots 84 are formed which pivotally receive a rear tilt lock plate 85 as also will be discussed in more detail hereinafter. Still further, a rectangular central opening 86 is formed rearwardly of the slots 84 and is located directly above the spindle mounting bracket 35 in the control housing interior. Preferably, the periphery of the opening 86 is defined by an upturned lip 87 which provides additional rigidity to the top wall 76. On the right side of this opening 86, a further opening 88 is formed through the top wall 76 so as to permit an actuator mechanism (not illustrated) to extend therethrough for actuating the rear tilt lock plate 85. Further, the rear edge of the top wall 76 includes an inclined flange 89 which projects upwardly and rearwardly therefrom and at least partially overlies the rear coil springs 43.

Figure 12:
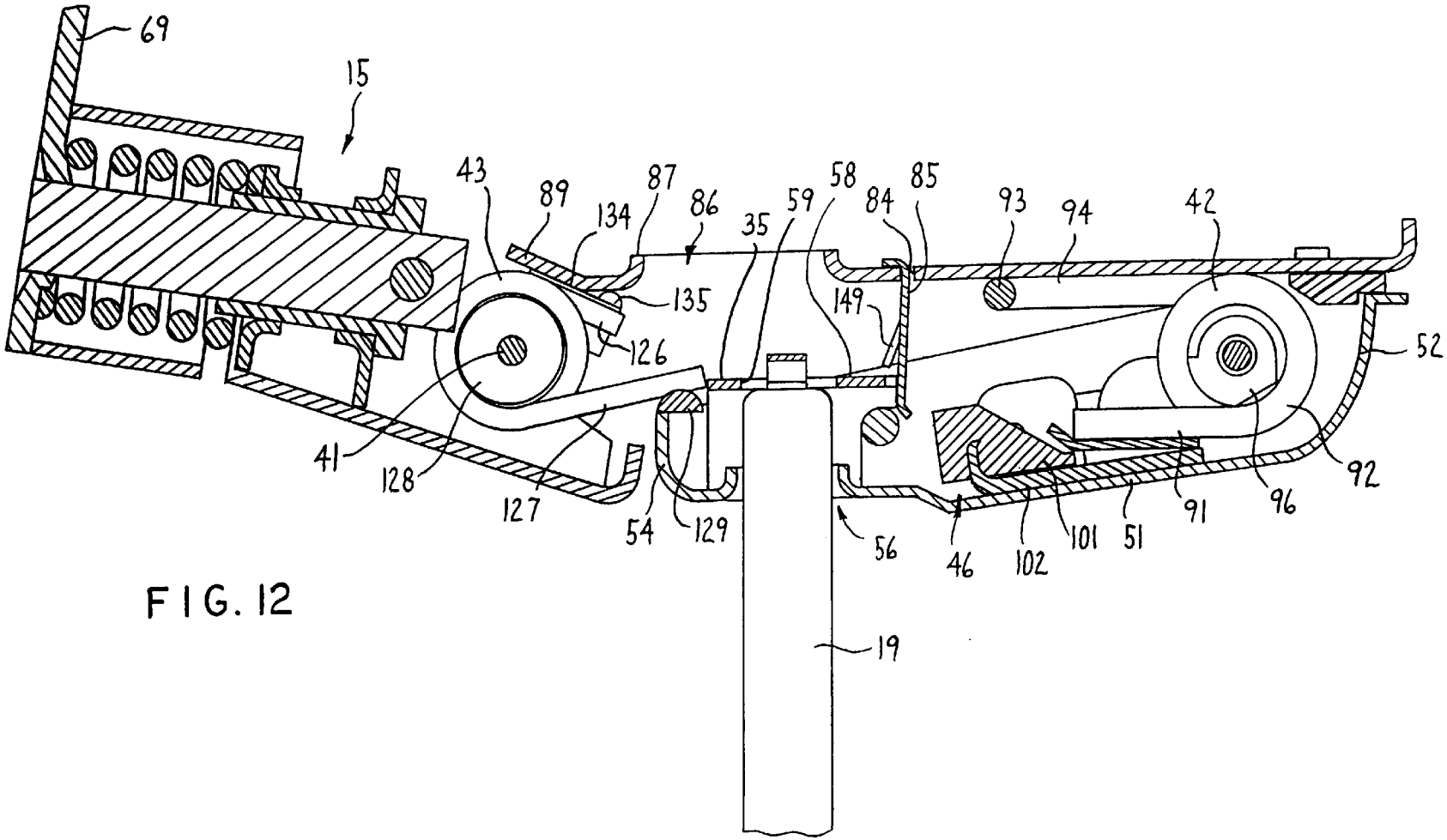
FIG. 12 a partial side elevational view in cross section illustrating the tilt control mechanism as viewed in the erection of arrows 12—12 in FIG. 14.

Referring to FIGS. 11 and 12, the tilt control mechanism 14 further includes a spring arrangement within the hollow interior of the control housing 34 which acts upwardly on the top plate 39 so as to normally urge the back assembly 12 and seat assembly 11 to the forward position (FIG. 7). This spring arrangement, however, permits rearward tilting of the seat and back assemblies 11 and 12 in response to movement by a user.

This spring arrangement preferably includes the aforementioned front spring 42 and the rear springs 43. Both the front and rear springs 42 and 43 act upwardly on the top plate 39.

More particularly, the front spring 42 preferably is formed from a single length of a coil spring material. Accordingly, the front spring 42 includes lower legs 91 which are defined by the opposite ends of the coil spring material, a plurality of adjacent spring coils 92 and a bridging section 93 which extends sidewardly between the opposite end coils 92 to define an upper leg 94 of the spring 42.

To support the front spring 42 in the control housing 34, the front pivot rod 40 extends coaxially through the center of the spring coils 92 and includes a hollow cylindrical plastic spacer 96 (FIG. 15) which supports the spring coils 92 thereon. The coils 92 fit closely about the outer circumference of the spacer 96, and the lower and upper spring legs 91 and 94 preferably extend rearwardly away from the housing front wall 52.

The upper spring leg 94 thereby acts upwardly on the bottom surface of the top plate 39, while the lower spring legs 91 act downwardly toward the housing bottom wall 51. While the front spring 42 is resiliently flexible and permits downward pivoting of the top plate 39, the spring 42 applies an upward acting spring force to return the top plate 39 to the forward position.

To adjust the tension in the front coil spring 42, the side tension adjustment mechanism 46 (FIGS. 10, 12 and 15) is provided within the control housing 34 and preferably acts on the lower legs 91 to adjust the spring force applied against the top plate 39.

Generally, the tension adjustment mechanism 46 includes a plastic wedge block 101 which is movable forwardly and rearwardly so as to raise and lower the lower legs 91 and increase and decrease the spring tension respectively. The tension adjustment mechanism 46 includes a steel guide plate 102 that defines an upturned angled track 103 on which the wedge block 101 is slidably engaged. The wedge block 101 slides forwardly along the track plate 102 in response to sideward pushing by the tension adjustment knob 47. In particular, the adjustment knob serves to drive an elongate shaft 104 sidewardly against the wedge block 101 wherein the wedge block 101 slides at an angle along the angled track 103 so as to move both sidewardly and forwardly underneath the lower legs 91. By suitable movement of the adjustment shaft 104, the wedge block 101 is moved forwardly or rearwardly to adjust the position of the lower legs 91.

More particularly, the track plate 102 includes a planar bottom section 106 which is welded onto the bottom wall 51 of the control housing 34 such that the track 103 remains stationary. The plate 102 also includes an upstanding support flange 107 which has an aperture 108 for receiving the adjustment shaft 104. To support the flange 107, a brace 109 (FIGS. 10, 13 and 15) extends sidewardly from the flange 107 and is welded to the housing side wall 53. Further, the track plate 102 includes an adjustment nut 111 (FIG. 15) which is welded on the inner side of the support flange 107 and is threadingly engaged with the adjustment shaft 104. As a result, the adjustment shaft 104 is laterally movable into and out of the control housing 34.

To slidably guide the wedge 101, the track 103 is formed along one edge of the bottom section 106, and extends upwardly therefrom. The track 103 preferably is formed at an angle of approximately 45° relative to the axis of the front pivot rod 40.

With respect to the adjustment shaft 104, the distal end thereof includes a threaded portion 112 as well as a convex drive knob 113 at the end thereof. The threaded portion 112 is engaged with the adjustment nut 111 such that rotation thereof causes the shaft 104 to be moved laterally toward and away from the wedge 101. Preferably the threaded engagement of the adjustment shaft 104 and the stationary nut 111 is through "acme" type threads which make it easier for a user to rotate the adjustment knob 67.

The drive knob 113 abuts against the side of the wedge block 101 to push the wedge 101 sidewardly as the shaft 104 is advanced into the control housing 34 as described in more detail hereinafter. Since the wedge 101 also moves forwardly as it moves along the track 103, the drive knob 113 is convex to reduce its contact area with the wedge 101 and reduce friction therebetween during forward movement of the wedge 101.

To move the wedge block 101, the bottom surface of the wedge block 101 includes a channel 116 which preferably is formed at an angle in the range of 35°–55° and preferably at approximately a 45° angle. The angle of the channel 116 corresponds to the angle of the track 103. The channel 116 is adapted to receive the track 103 therein so that the wedge 101 is freely slidable therealong in response to the sideward movement of the adjustment shaft 104.

Preferably, the wedge block 101 is formed of an acetal or other suitable plastic or low-friction material which freely permits sliding of the wedge block 101. To further decrease friction, the wedge block 101 is formed with additional shallow channels (not illustrated) on the bottom surface thereof which are parallel to the deep channel 116 and thereby reduce the overall surface area on the bottom of the wedge block 101 which is in contact with the track plate 102.

Figure 15:
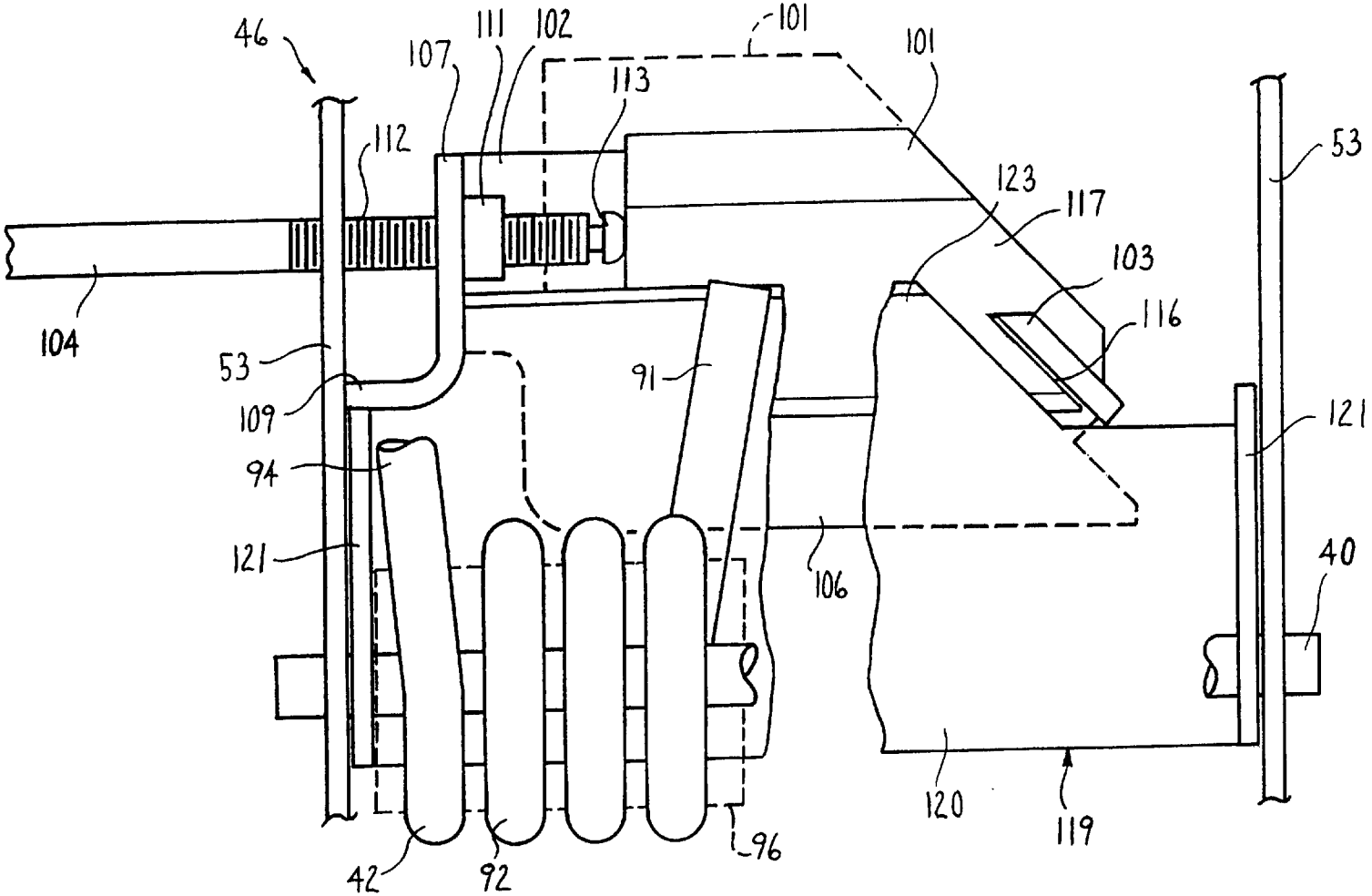
FIG. 15 is an enlarged top plan view of a tension adjustment mechanism.
Figure 16:
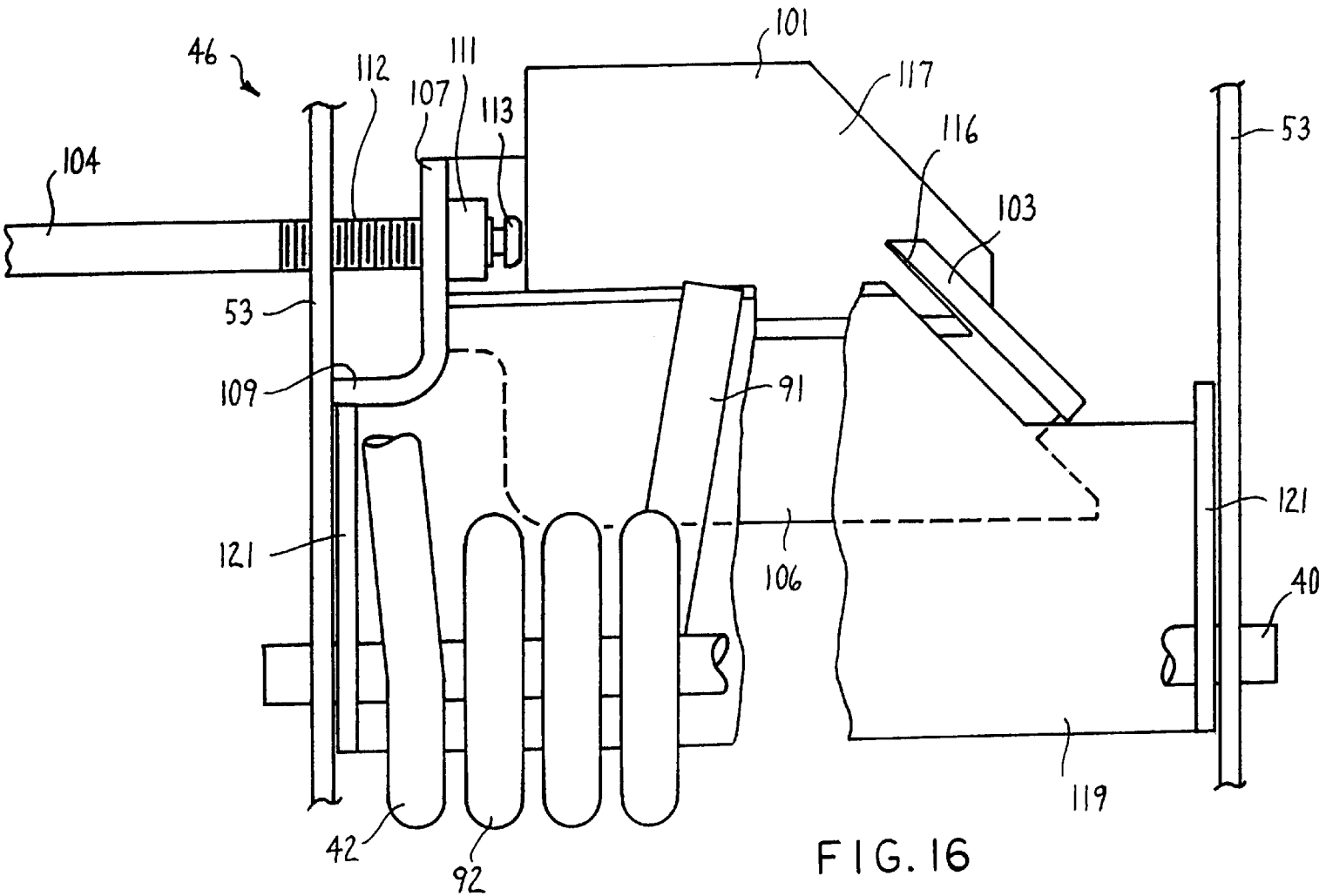
FIG. 16 is an enlarged top plan view of the tension adjustment mechanism in a withdrawn position.
Figure 17:
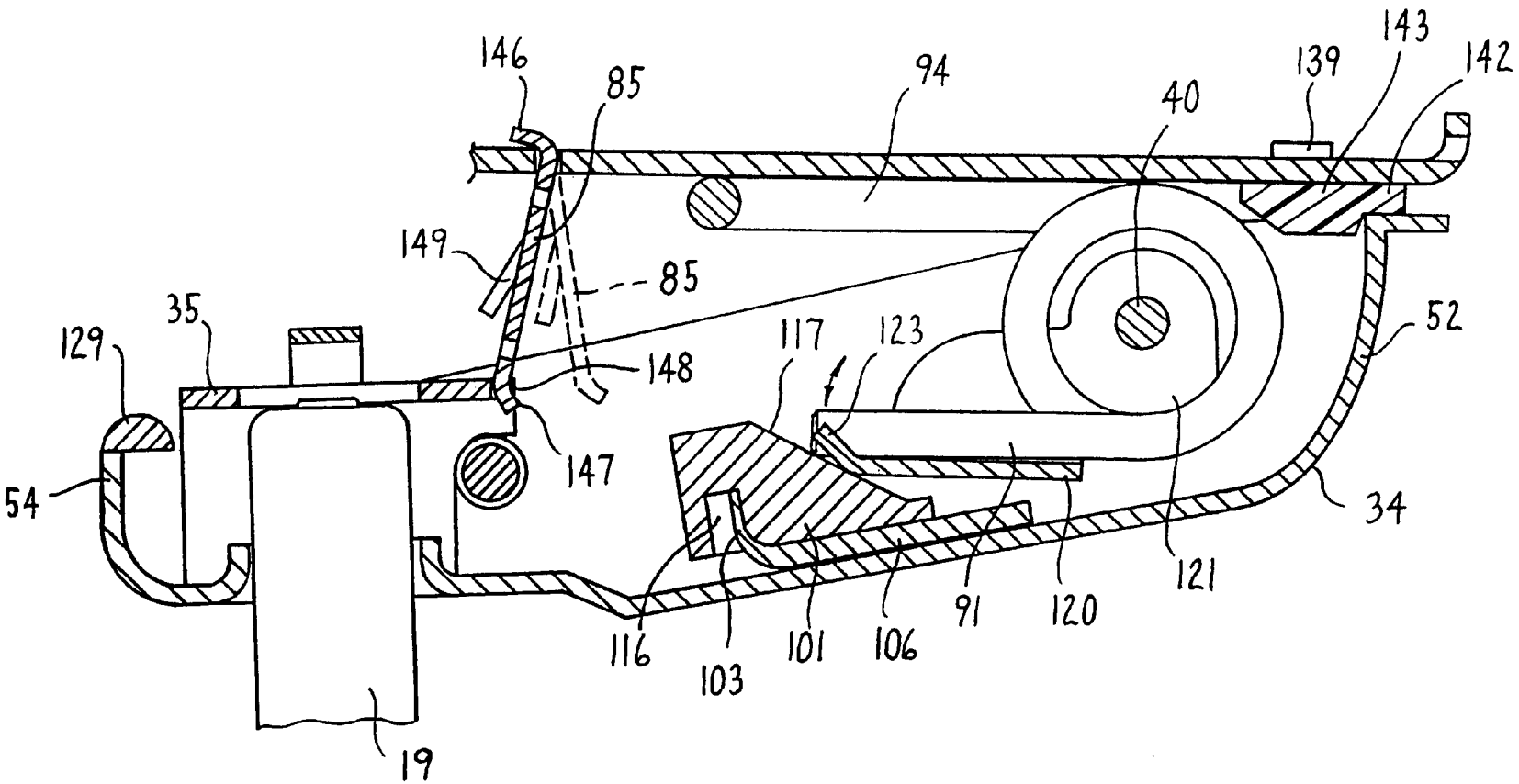
FIG. 17 is an enlarged partial side elevational view in cross section illustrating the tension adjustment mechanism of FIG. 16.

Accordingly, in response to rotation of the adjustment shaft 104, the shaft 104 is advanced or moved sidewardly as generally illustrated in FIGS. 15 and 16 so as to apply a sideward driving force on the side surface of the wedge block 101. However, since the wedge block 101 is slidably engaged with the guide track 103, the wedge 101 thereby moves at an angle along the track 103 between a withdrawn position (FIGS. 12 and 16) and an inserted position (FIGS. 15 and 17). This movement along the track 103 has both a sideward component of motion as well as a forward component of motion. It is the forward component of motion that serves to drive lower spring legs 91 upwardly as seen in FIG. 17.

The wedge block 101 preferably has an inclined surface 117 on the front face thereof which is inclined at an angle in the range of 30°–50° and preferably at an angle of approximately 40° relative to the bottom surface of the wedge 101 and serves to raise and lower the lower spring leg 91. The angle of the inclined surface 117 can be varied although it is selected so as to permit free sliding of the wedge block 101 underneath the spring legs 91 while at the same time, being sufficiently steep such that the downward force of the spring legs 91 tends to urge the wedge block 101 rearwardly. Thus, when the adjustment shaft 104 is backed out of the control housing 34 (FIG. 16), the wedge block 101 is pressed rearwardly by the lower spring legs 91 to slide back up the track 103. Accordingly, the drive knob 113 of the shaft 104 need only abut against the side of the wedge block 101 and a positive connection is not required therebetween. As the wedge block 101 is driven sidewardly and forwardly, the side surface of the wedge 101 slides freely along the drive knob 113 in the forward direction.

Preferably, the tension adjustment mechanism 46 also includes an intermediate support plate 119 which is provided between the inclined surface 117 of the wedge 101 and the bottom of the lower spring legs 91. The support plate 119 (FIG. 10) includes a central section 120 (FIGS. 10 and 15)which is placed between the wedge 101 and the lower spring legs 91.

To mount the support plate 119 in position, the central section 120 is formed with upturned flanges 121 on the opposite sides thereof. The flanges 120 include apertures 122 which are adapted to receive the front pivot rod 40 therethrough such that the support plate 119 is movable upwardly and downwardly about the front pivot rod 40. The support plate 119 also includes an inclined flange 123 along the rearward free edge thereof. To avoid interference with the upstanding track 103, the plate 119 is notched on the right side thereof.

When the plate 119 is supported on the pivot rod 40, the plate 119 supports the lower spring legs 91 on an upper surface thereof. During operation, the inclined surface 117 of the wedge 101 slides underneath the support plate 119 to drive the plate 119 as well as the lower spring legs 91 upwardly.

The support plate 121 thereby serves several functions in that the inclined flange 123 provides an inclined surface 123 which slides up the wedge 101 to provide for smooth sliding of the wedge 101. The inclined flange 123 also prevents the direct contact of sharp edges, such as the ends of the lower legs 91, with the inclined wedge surface 117 which might otherwise gouge the inclined surface 117. Further, the support plate 119 distributes the forces being applied by the lower spring legs 91 over the central plate section 120 which avoids localized forces that might be applied directly to the inclined wedge surface 117 by the lower spring legs 91.

Also, the support plate 119 isolates the spring legs 91 from the sideward motion of the wedge 101. In particular, the side flanges 121 not only serve to mount the support plate 119 on the rod 40, but they also abut against the side walls 53 of the control housing 34 as seen in FIG. 15 so as to limit sideward movement thereof. Otherwise if the wedge 101 directly contacted the spring legs 91, the wedge block 101 would tend to urge the lower legs 91 not only upwardly but also sidewardly due to friction which could lead to undesirable distortion of the front spring 42.

As can be seen, the tension being applied by the front spring 42 is adjusted by manual rotation of the adjustment knob 47 and selective driving of the adjustment shaft 104 into and out of the control housing 34.

While the tension adjustment mechanism 46 acts on the lower spring legs 91 of the front spring 42, the skilled artisan will also appreciate that the tension adjustment mechanism 42 could be used to press the upper spring leg 94 downwardly to adjust the spring force. Further, the skilled artisan will appreciate that the tension adjustment mechanism 42 is usable on other types and arrangements of springs to adjust the spring forces being applied by the spring.

With respect to the rear springs 43, the springs 43 act in combination with the front spring 42 to urge the top plate 39 upwardly. Generally, each of the rear springs 42 includes an upper leg 126 which acts upwardly on the top plate 39, and a lower leg 127 which acts downwardly on the rear wall 54 of the control housing 34.

More particularly, the rear coil springs 43 are supported on the rear pivot rod 41 in substantially coaxial relation therewith by inner plastic spacers 128. The inner plastic spacers 128 are substantially cylindrical and have a bore therethrough so as to receive the rear pivot rod 41. Thus, as the back support member 36 pivots downwardly, some rotational movement of the rear springs 43 relative to the rear pivot rod 41 is permitted.

To bias the top plate 39 upwardly, the lower legs 127 of the springs 43 extend forwardly into the control housing 34 and act downwardly upon the rear housing wall 54. Preferably, the rear springs 43 are formed as mirror images of each other such that the lower legs 127 thereof are both spaced inwardly of the housing side walls 53. The lower legs 127 are supported on the rear wall 54 by a semi-cylindrical steel support pin 129 which is welded thereto. Preferably, the support pin 129 has a semi-circular shape and includes two peripheral grooves 130 near the opposite ends thereof which positively retain the lower spring legs 127 therein. The peripheral grooves 130 define arcuate bearing surfaces 131 on which the lower spring legs 127 act.

Referring to FIGS. 15 and 16, the lower spring legs 127 extend generally forwardly and horizontally when the top plate 39 is in forward tilted or in the normal position illustrated in FIGS. 8 and 9. In either position, the lower spring legs 127 act downwardly onto the top of the arcuate bearing surface 131. As a result, substantially all of the spring forces of the rear coil springs 43 act upwardly on the top plate 39 since the lower legs 127 act in an opposite direction downwardly.

Figure 18:
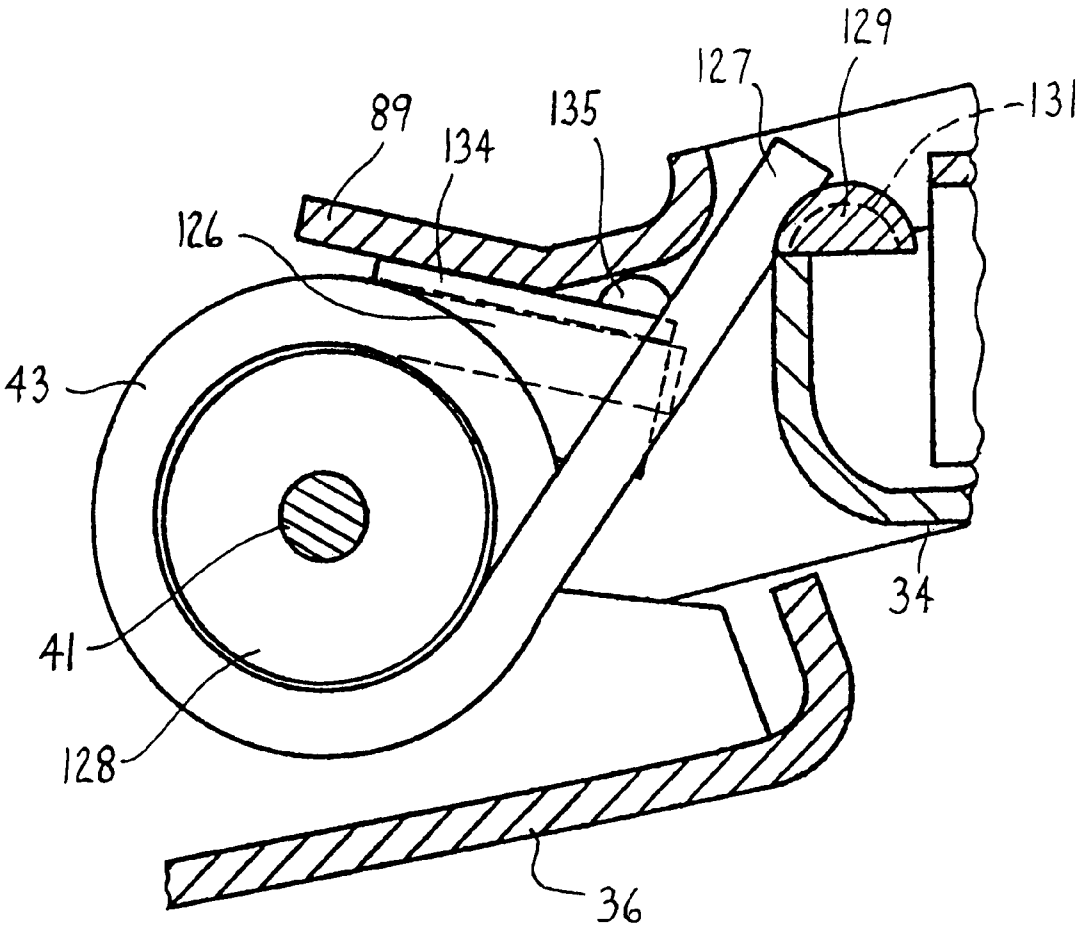
FIG. 18 is an enlarged partial side elevational view in cross section illustrating a rear spring in the rearwardly tilted position.

However, upon rearward tilting of the top plate 39 and back support member 36, the rear springs 43 which are joined to the back support member 36 move downwardly therewith such that the angle of the lower spring legs 127 changes significantly. In particular, as seen in FIG. 18, the lower spring legs 127 are steeply inclined so as to act generally on the side surfaces of the arcuate bearing surface 131 instead of the top thereof. While the force of the lower spring legs 127 acting on the arcuate bearing surface 131 preferably has a vertical component which acts downwardly on the support pin 129, most of the spring forces act sidewardly or forwardly on the pin 129 with a horizontal force component. Thus, the magnitude of the forces acting upwardly on the top plate 39 is significantly less than would otherwise occur if the lower legs 127 acted solely with a vertical force component. This is desirable since the rear springs 43 still serve to urge the chair to its normal position. Further, the upward acting force on the chair is reduced when the seat and back assemblies 11 and 12 are pivoted rearwardly to the rear position illustrated in FIGS. 9 and 18 since the lower legs 127 also act with the horizontal force component. Thus, a user can tilt the chair to the rearwardly reclined position (FIG. 9) with significantly less tilting force than would otherwise be required to tilt the chair rearwardly. This reduction in force further optimizes the comfort of a user.

With respect to the upper spring legs 126, these legs 126 preferably extend below the top plate 39 so as to act upwardly. However, since some sliding or displacement of these upper spring legs 126 along the lower surface of the top plate 39 occurs during rearward tilting of the chair, an intermediate plastic bearing plate 134 is preferably provided to reduce the friction generated between the top plate 39 and the upper spring legs 126.

Preferably, the bearing plate 134 is formed as an extension of the plastic spacers 128. In particular, the bearing plate 134 is cantilevered from an outer end of the plastic spacers 128 and projects forwardly and below the top plate 39 so as to be in contact with the inclined flange 89. Preferably, the free end of the bearing plate 134 also includes a rounded rib 135 projecting upwardly therefrom which contacts the bottom of the top plate 39. The rib 135 is preferred since it reduces the amount of surface area of the bearing plate 134 which is in contact with the top plate 39.

As a result of the spring arrangement disclosed herein, the upward acting forces on the top plate 39 can be varied during use. In particular, the forces being applied by the front spring 42 are continuous during use but can be adjusted by the tension adjustment mechanism 46. The rear springs 43, however, which assist the front spring 42 not only provide a spring force which acts upwardly on the top plate 39, but also serve to vary the overall spring force acting on the top plate 39. In particular, the spring force provided by the rear springs 43 is reduced when the top plate 39 is raised to its forwardmost position since the deflection of the rear springs 43 is reduced. However, as the back support member 36 tilts downwardly, the lower legs 127 are significantly inclined. As a result, while the actual forces applied by the rear springs 43 increase, the forces applied by the lower legs 127 act with both the horizontal and vertical force components such that the vertical force urging the top plate 39 upwardly is less than would otherwise occur. The arrangement of the rear springs 43 and the support pin 129 serves to reduce the effective spring rate of the rear springs 43 as the chair is reclined. This reduction in spring force allows a user to maintain the chair 10 in the fully reclined position with significantly less force than was required to tilt the chair rearwardly.

By separating the forces being applied to the top plate 39 through the use of both the front spring 42 and the rear springs 43, the overall height or profile of the tilt control mechanism 14 is reduced.

With the foregoing structure, the seat and back assemblies 11 and 12 tilt both forwardly and rearwardly. However, it is also desirable to be able to lock out either the forward tilting or the backward tilting or both. Thus, the tilt control mechanism 14 also includes a front locking arrangement and a rear locking arrangement.

The front locking arrangement includes the aforementioned front tilt lock block 82 (FIGS. 10 and 13) which is slidably engaged with the top plate 39.

In particular, the front block 82 includes upstanding pins 139 which are inserted from below into the wide end of the slots 81 formed at the front of the top plate 39. The pins 139 have a reduced diameter section which allows for sliding of the pins 139 along the reduced diameter portion of the slots 81. By sliding the front block 82 along the slots 81, the front block 82 is movable forwardly and rearwardly relative to the front housing wall 52. The forward and rearward movement of the front tilt lock plate 82 is effected by a front actuation mechanism (not illustrated) which is activated by rotation of a front locking knob 140 (FIGS. 1–4). The front locking knob 140 serves to rotate an elongate rod 138 (FIG. 4) which is supported by one of the arms 28 of the seat support frame 25. The inner end of this rod 138 includes a leg which pivots upon rotation of the front locking knob 140 and abuts against a lever (not illustrated) mounted on the control housing 34 that pivots about a vertical pivot axis. The lever (not illustrated) thereby acts against the rightward pin 139 of the front tilt lock plate 82 which is formed with a cylindrical bearing surface 141 so as to be movable forwardly and rearwardly along the angled slots 81. Thus, upon clockwise and counter-clockwise rotation of the front locking knob 140, the front tilt lock block 82 can be moved forwardly and rearwardly.

Referring to FIG. 11, the front tilt lock block 82 includes a thin portion 142 along the front edge thereof, and a thick portion 143 along a rear edge thereof. Locking out of forward tilting is accomplished by moving the thicker portion 143 of this front tilt lock block 82 into the space formed between the upper edge of the front wall 52 and a bottom surface of the top plate 39.

In particular, when the thin portion 142 is disposed in the gap formed between the housing front wall 52 and the top plate 39 as seen in FIG. 12, the top plate 39 is able to pivot forwardly about the front pivot axis P1 to the forwardly tilted position illustrated in FIG. 9. Upon rearward tilting of the top plate 39, however, the front edge thereof pivots upwardly away from the top edge of the housing front wall 52.

Thus, to lock out the forward tilting, the front tilt lock block 82 can be moved forwardly into this space such that the thick portion 143 is positioned between the housing front wall 52 and the top plate 39. This thick portion 143 thereby prevents forward tilting of the top plate 39 past the normal horizontal chair position illustrated in FIG. 8. Upon rearward movement of the front tilt lock plate 82 out of this space, forward tilting can then be resumed. However, even though forward tilting is locked out, rearward tilting is still permitted.

To also lock out the rearward tilting of the chair 10, the aforementioned rear tilt lock plate 85 is provided as seen in FIGS. 10 and 12. The rear tilt lock plate 85 includes rearwardly extending flanges 146 along the top edge thereof which are adapted to be slid from below into the corresponding slots 84 (FIG. 14) formed in the top plate 39. The rear tilt lock plate 85 thus is pivotally connected to the top plate 39 so as to be movable forwardly to the forwardmost position illustrated in FIG. 12 and rearwardly into an interfering relation with the mounting bracket 35 located in the control housing 34.

More particularly, when the rear tilt lock plate 85 is disposed in the forwardmost position illustrated in phantom outline in FIG. 17, rearward tilting of the seat and back assemblies 11 and 12 is permitted. However, the rear tilt lock plate 85 can be rearwardly swung into an interfering relation with the mounting bracket 35 to lock out rearward tilting when the chair is either in the forwardmost position (FIG. 9), or the normal horizontal position (FIG. 8).

To lock the chair in the forward tilted position (FIGS. 9 and 10), the bottom edge of the rear tilt lock plate 85 includes a central tab 147 which projects downwardly therefrom. This tab is adapted to be slidably received into a corresponding notch 148 formed in the front edge of the mounting bracket 35. When the central tab 147 seats in this notch 148 as seen in FIG. 17, the lower edge of the rear tilt lock plate 85 is seated on the top surface of the mounting bracket 35. The rear tilt lock plate 85 thereby acts as a brace which extends upwardly from the mounting bracket to the bottom surface of the top plate 39 which prevents rearward tilting of the top plate 39.

Figure 19:
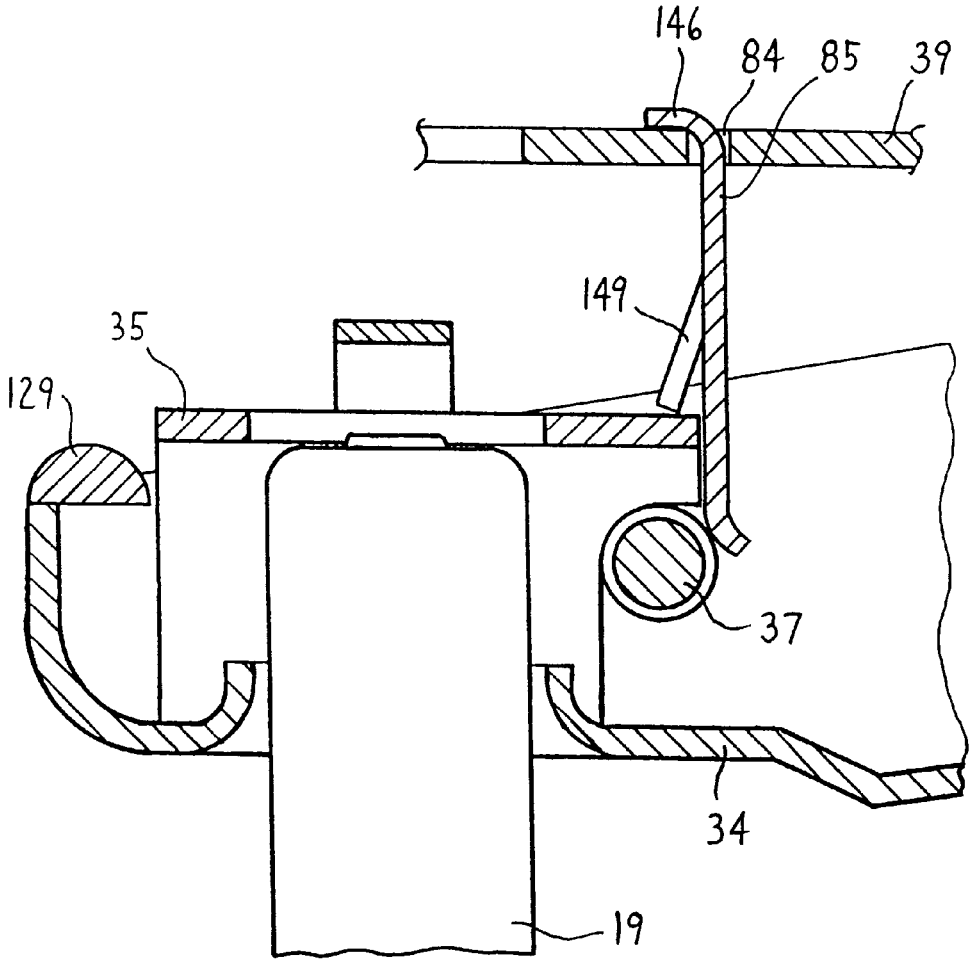
FIG. 19 is an enlarged partial side elevational view in cross section illustrating a rearward tilt lock in a locked position.

The rear tilt lock plate 85 also is usable to lock out rearward tilting of the chair 10 from the normal horizontal position while still permitting forward tilting thereof. In particular, the rear tilt lock plate 85 also includes a pair of tabs 149 (FIGS. 10 and 19) which project rearwardly and downwardly from the plate 85. To lock out rearward tilting, the rear tilt lock plate 85 is tilted rearwardly until the lower edge thereof abuts against the front edge of the mounting bracket 35. When the rear tilt lock plate 85 is in this position, the rearwardly projecting tabs 149 are disposed directly above the front edge of the mounting bracket 35 and act as a stop upon rearward tilting of the top plate 39. While forward tilting is permitted, rearward tilting of the top plate 39 causes the tabs 149 to move downwardly until they contact the top surface of the mounting bracket 35 and thereby limit or stop further rearward tilting.

The forward and rearward swinging of the rear tilt lock plate 85 is provided by a rear tilt lock actuation mechanism (not illustrated). The rear tilt lock actuation mechanism is controlled by a rear locking knob 151 (FIGS. 1–3) which is rotated clockwise and counter-clockwise to rotate an elongate rod 152 which is mounted on the rear support arm 28 of the seat support frame 25. This rod 152 causes movement of the lock plate 85.

In view of the foregoing, the tilt control mechanism 14 is tiltable both forwardly and rearwardly. Further, this forward and rearward tilting can be locked out by a user.

Figure 20:
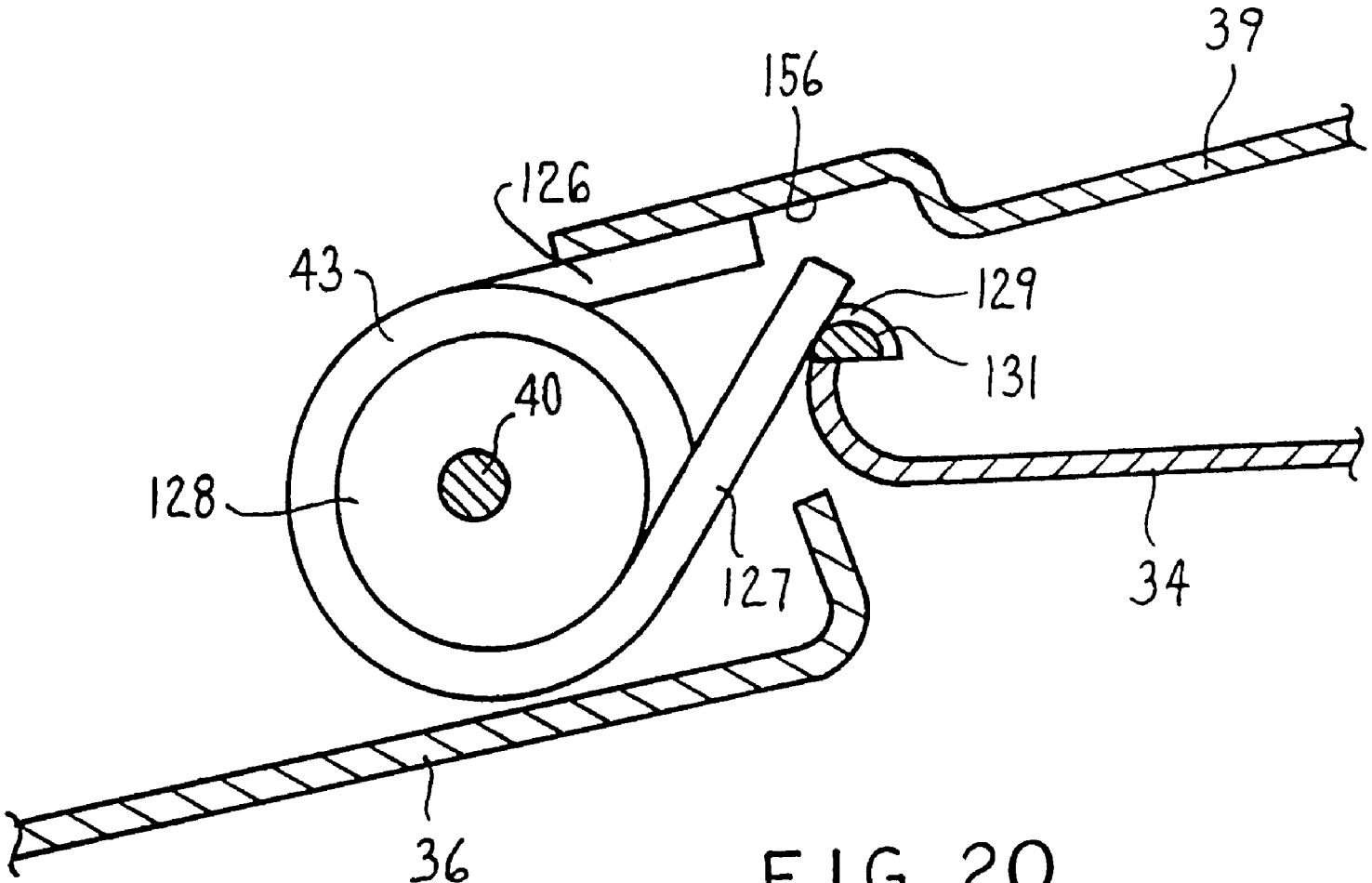
FIG. 20 is an enlarged partial side elevational view in cross section illustrating a rear spring of a second embodiment of the invention in the rearwardly tilted positions

In a further embodiment illustrated in FIG. 20, the plastic spacers 128 may be eliminated while the upper spring legs 126 are received in a downward opening pocket 156. The pocket 156 is formed in the top plate 39 and slidably receives the upper spring legs 126 therein. The pocket 156 therefore guides the spring leg 126 during movement of the back support member 36.

Alternatively, the pocket 156 also can be formed as a separate bracket which is fastened to the top surface of the top plate 39. In particular, the pocket 156 can be formed as a downward-opening U-shaped bracket which is bolted onto the top plate 39 and traps the upper spring leg 126 therein. In this arrangement, the inclined flange 123 is eliminated and the spring legs 126 extend over the top of the top plate 39.

Referring to FIGS. 21–32, an improved tilt control mechanism 14-1 is illustrated. The tilt control mechanism 14-1 operates substantially the same as the tilt control mechanism 14 for rearward tilting of the chair and the following discussion therefore is directed to the improvements in the tilt control mechanism 14-1. Since both of the tilt control mechanisms 14 and 14-1 include common components which operate substantially the same or serve the same function, these common components in the tilt control mechanism 14-1 are identified by the same reference numerals previously defined herein, although designated with "-1" at the end thereof.

Figure 21:
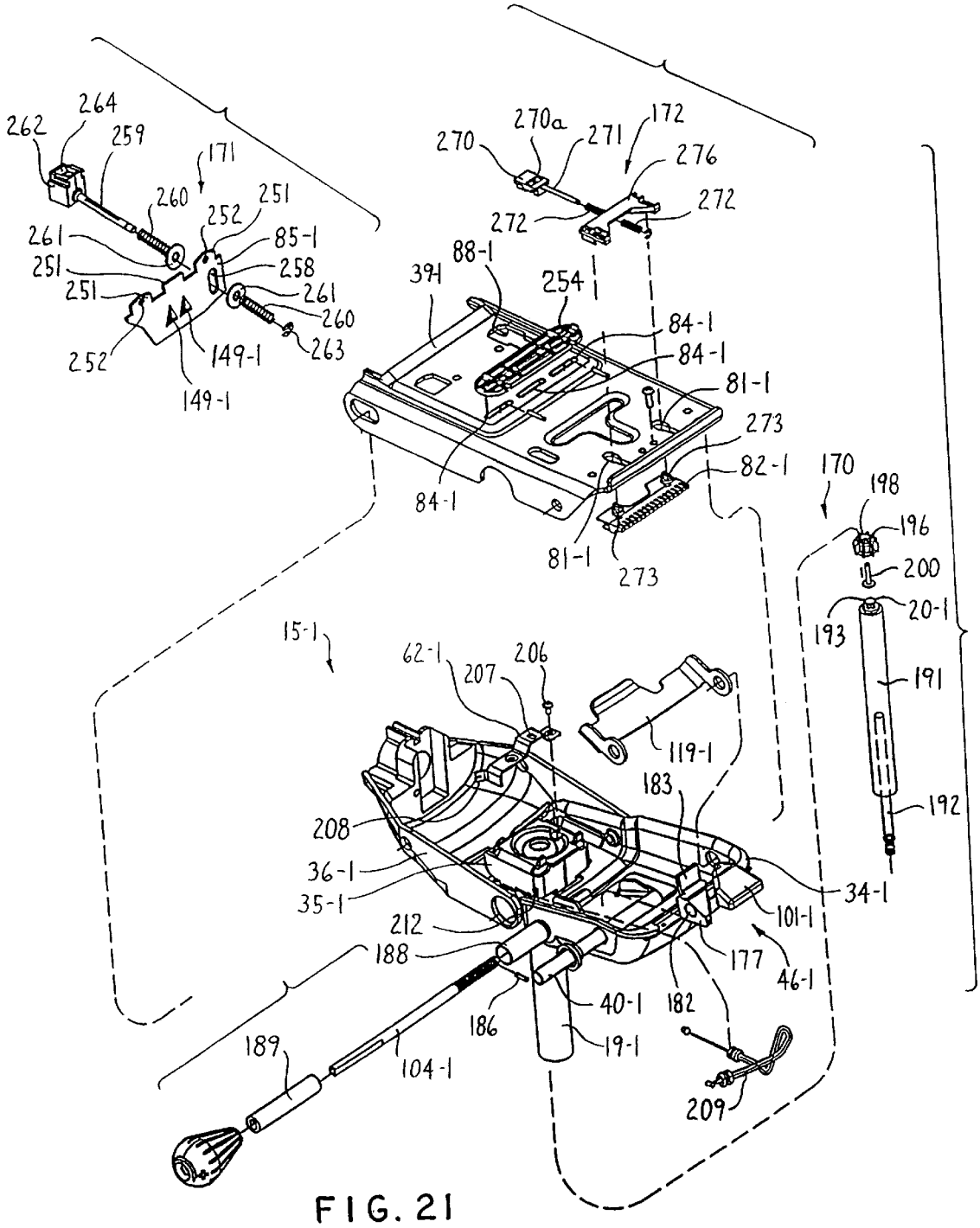
FIG. 21 is a front perspective view of a further embodiment of the tilt control mechanism of the invention.

As seen in FIG. 21, the tilt control mechanism 14-1 includes a control housing 34-1, a seat back support member 36-1 and a top plate 39-1 which are supported on the spindle 19-1 and are pivotally connected together by pivot pins, such as the front pivot rod 40-1, to permit rearward tilting of the chair. Front and rear spring arrangements are positioned in the control housing 34-1 to urge the chair forwardly to its upright position. These components interact and function in substantially the same manner as the equivalent components in the tilt control mechanism 14 described previously and thus, a more detailed discussion of these components is not believed necessary.

One difference, however, in the tilt control mechanism 14-1 is that the above-described dwell provided by the rear spring arrangement preferably is minimized. To minimize the dwell, the control housing 34-1, top plate 39-1 and support member 36-1 are formed such that the top plate 39-1 contacts the control housing 34-1 prior to a let off in the rear spring load.

With respect to the other primary differences in the tilt control mechanism 14-1, this mechanism includes an improved tension adjustment mechanism 46-1, pneumatic adjustment mechanism 170, rear lock actuator mechanism 171 and front lock actuator mechanism 172.

Figure 22:
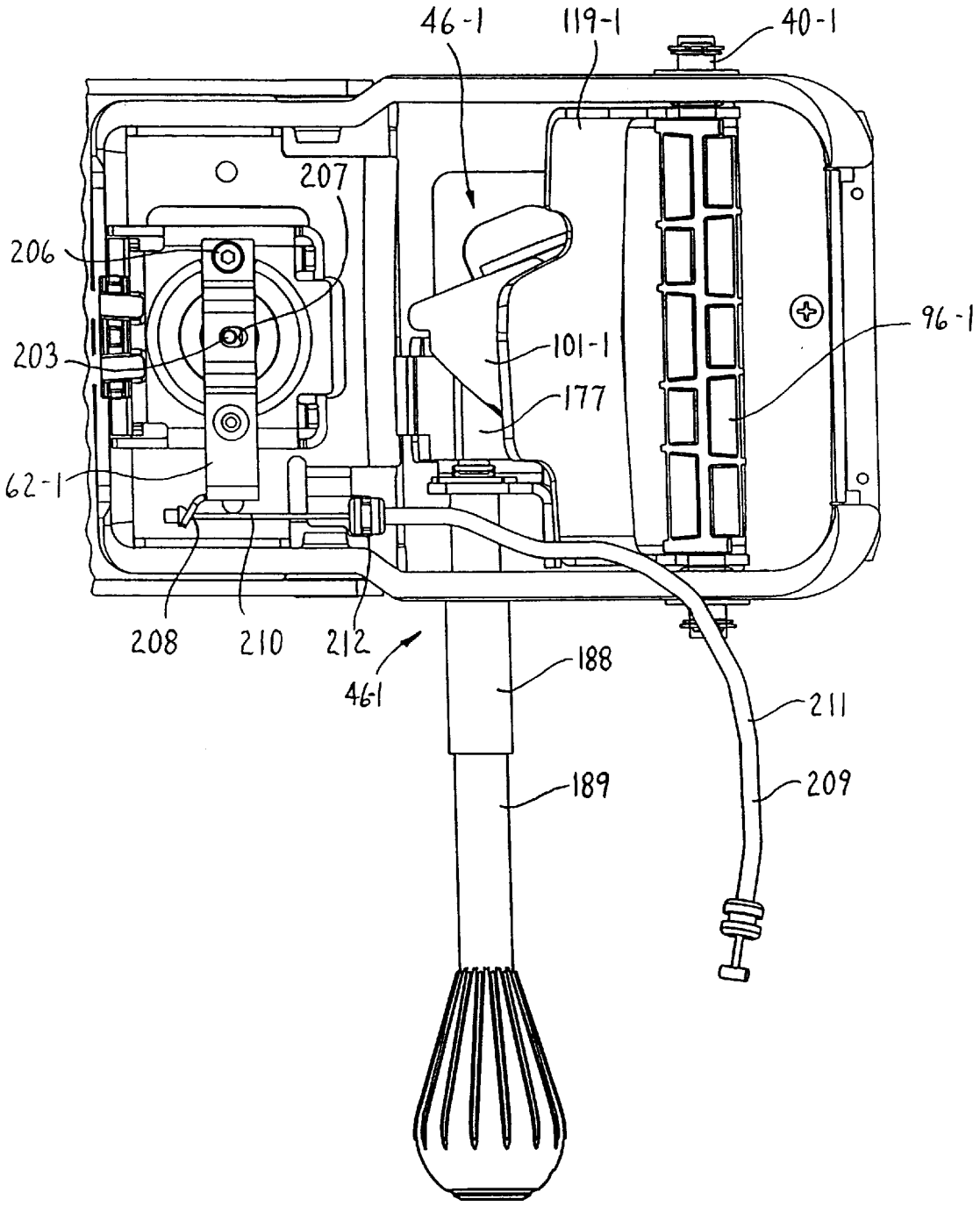
FIG. 22 is a partial top plan view of the control housing.
Figure 23:
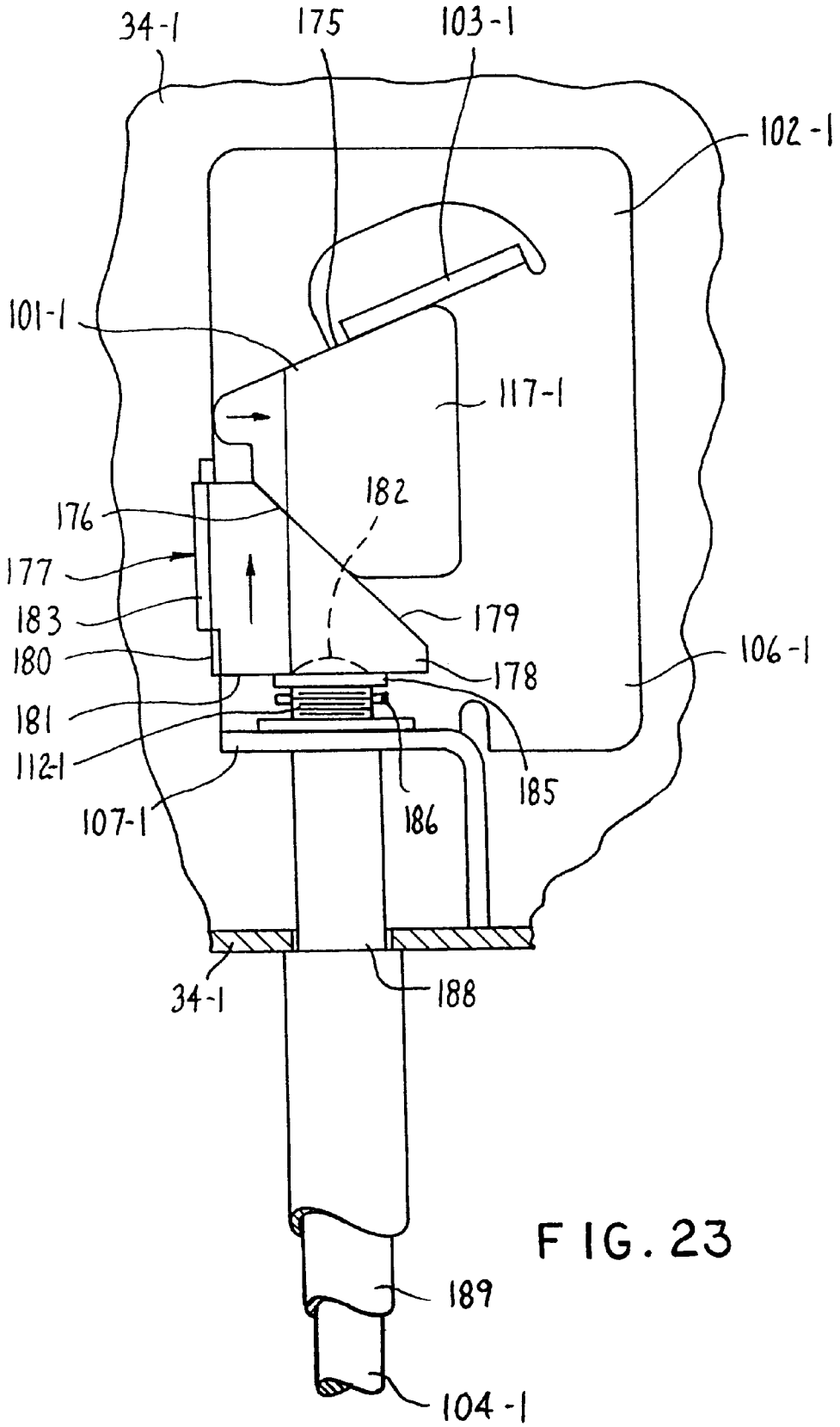
FIG. 23 is an enlarged top plan view of a tension adjustment mechanism.
Figure 24:
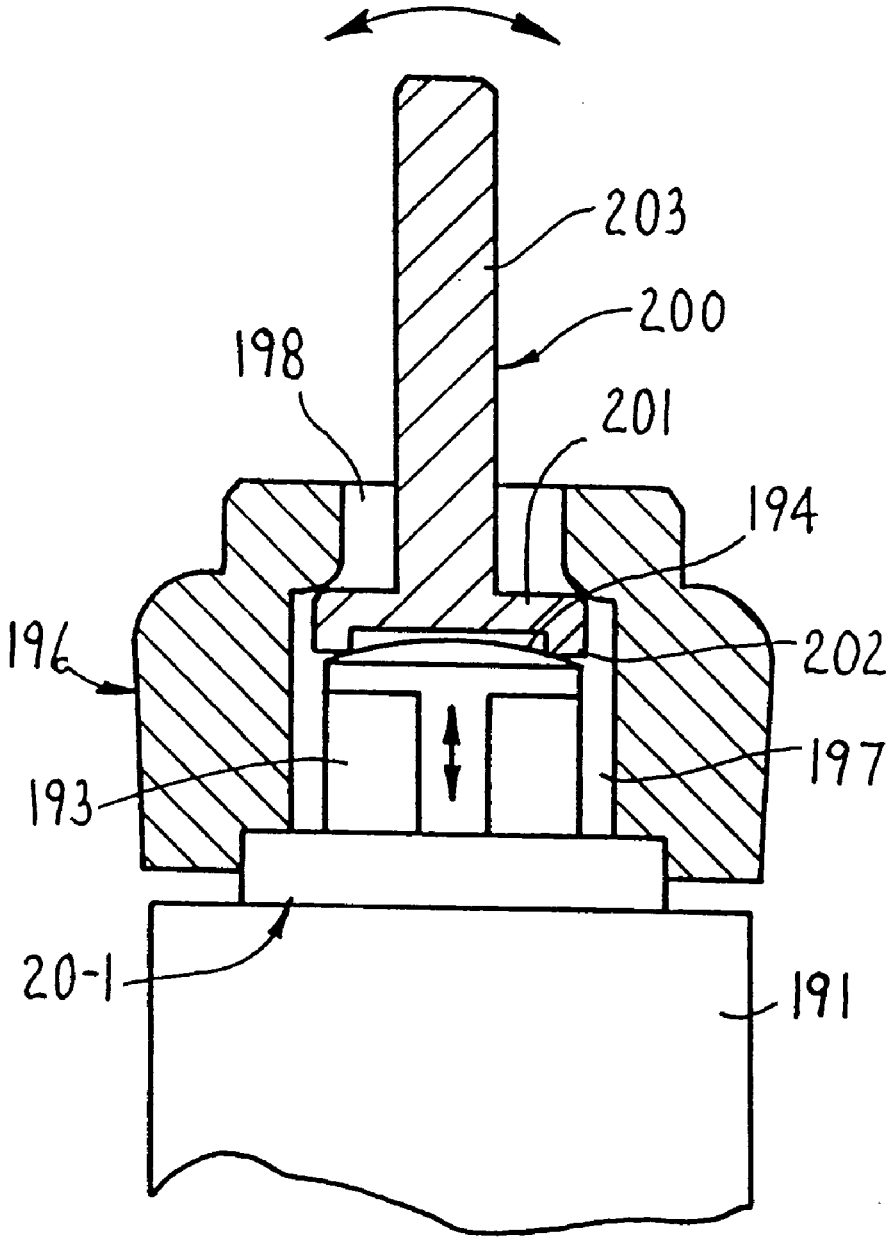
FIG. 24 is a partial front cross sectional view of a pneumatic actuator mechanism.

With respect to the tension adjustment mechanism 46-1 as seen in FIGS. 21–23, this mechanism functions substantially the same as the mechanism 46 in that it wedges the spring legs of the front spring upwardly to adjust the spring force provided thereby. In operation, the tension adjustment mechanism 46-1 converts sideward movement of an adjustment shaft 104-1 into forward movement of a wedge block 101-1 so as to raise and lower the lower spring legs.

More particularly, the tension adjustment mechanism 46-1 includes a steel guide plate 102-1 (FIG. 23) which has a bottom section 106-1 that is mounted on the floor or bottom of the control housing 34-1. The guide plate 102-1 includes an upstanding guide flange 103-1 that extends at an angle of approximately 20-25 degrees and preferably 22.5 degrees relative to the forward-rearward axis of the control housing 34-1. The plate 102-1 further includes an upstanding support flange 107-1 which is threadingly engaged with a threaded section 112-1 of the shaft 104-1 so as to effect axial or sideward movement of the shaft 104-1 during manual rotation thereof.

The wedge block 101-1 is modified from the block 101 in that the block 101-1 is tapered on its opposite sides 175 and 176 so as to be generally V-shaped when viewed from above. The side surface 175 is at an angle corresponding to the angle of the guide flange 103-1 and slidably abuts against the opposing face of the guide flange 103-1 so that the block 101-1 slides generally in the forward-rearward direction. The opposite side surface 176 also is tapered at an angle of approximately 45 degrees so as to permit driving of the block 101-1 forwardly.

The wedge block 101-1 includes an inclined surface 117-1 on the front thereof which is inclined at approximately a 35 degree angle relative to the bottom thereof and slides under the pivoting plate 119-1 as described previously.

Further, an intermediate wedge block 177 is positioned between the adjustment shaft 104-1 and the block 101-1. The intermediate wedge block 177 includes an inclined front surface 178 upon which the steel plate 119-1 can rest. The inclined surface 178 is at an angle of approximately 35 degrees so as to be substantially flush with the inclined surface 117-1 when in the position illustrated in FIG. 23.

The wedge block 177 also includes a side surface 179 which is at an angle corresponding to the angle of the opposing side surface 176 and slidably abuts against the side surface 176. To prevent rearward movement of the intermediate wedge block 177, the guide plate 102-1 includes an upstanding flange 180 at the rear edge thereof which abuts against the rear surface of the wedge block 177. Thus, upon sideward movement of the intermediate wedge block 177 toward the guide flange 103-1, the wedge block 101-1 is pressed or squeezed therebetween to effect forward movement of the wedge block 101-1.

The wedge block 177 also includes a vertical tab 183 projecting therefrom which limits forward movement of the rear locking plate 85-1.

To drive the intermediate wedge block 177 sidewardly, the opposite side surface 181 includes a concave pocket 182 (FIGS. 21 and 23) in which the tip end of the shaft 104-1 is received. The tip end of the shaft 104-1 also has a reduced diameter and includes a washer 185 thereon which abuts against the side surface 181 and prevents the shaft 104-1 from gouging the wedge block 177. Still further, a pin 186 projects radially from the threaded section 112-1 to prevent a user from unscrewing the shaft 104-1 from the threaded flange 107-1.

Further, to prevent bending of the shaft 104-1, a cylindrical support tube 188 projects out of the control housing 34-1 and slidably receives the shaft 104-1 therethrough. A sleeve 189 is also inserted into the support tube 188 so that the shaft 104-1 is supported along the length thereof.

With this improved tension adjustment mechanism 46-1, the shaft 104-1 is manually rotated to drive the intermediate wedge block 177 sidewardly which squeezes the wedge block 101-1 forwardly. The intermediate wedge block 177 therefore eliminates sliding of the shaft 104-1 along the block 177 which otherwise could cause wear.

Referring to FIGS. 21, 22, 24 and 25, the tilt control mechanism 14-1 also includes the improved pneumatic actuator 170 for raising and lowering the height of the seat assembly. The pneumatic actuator 170 is preferred since it effects vertical movement of the pneumatic valve 20-1 through a horizontal pivoting movement of the actuator lever 62-1, which is particularly advantageous in a tilt control having a lower profile or vertical height. Further, the pneumatic actuator 170, while actuated in a forward-direction in the tilt control mechanism 14-1, can be actuated in any horizontal direction if desired.

More particularly, a pneumatic pressure cylinder 191 is mounted in the spindle 19 and includes a cylinder shaft 192 at the lower end thereof. The pressure cylinder 191 is connected between the chair base and the control housing 34-1 so as to act therebetween and raise the seat assembly. The valve 20-1 (FIGS. 21 and 24) of 3the pressure cylinder 191 is located at the top thereof and includes a valve button 193 which can be depressed to open the valve 20-1 and permit adjustment of the seat height. The button 193 is vertically movable and includes an arcuate button surface 194.

The upper end of the pressure cylinder 191 is enclosed by a shroud 196 which is fixed in position or sandwiched between the pressure cylinder 191 on the lower side thereof and the pedestal mounting bracket 35-1 (FIG. 21) on the upper side thereof. The shroud 196 includes an increased diameter chamber 197 which seats over the button 193, and a passage 198 which extends vertically through the upper wall thereof.

To depress the button 193, a pin 200 is positioned in the chamber. In particular, the pin 200 includes a circular head 201 on the lower end thereof which has an annular rim 202 projecting downwardly into contact with the button surface 194. The upper surface of the circular head 201 contacts the top wall of the shroud 196.

Figure 25:
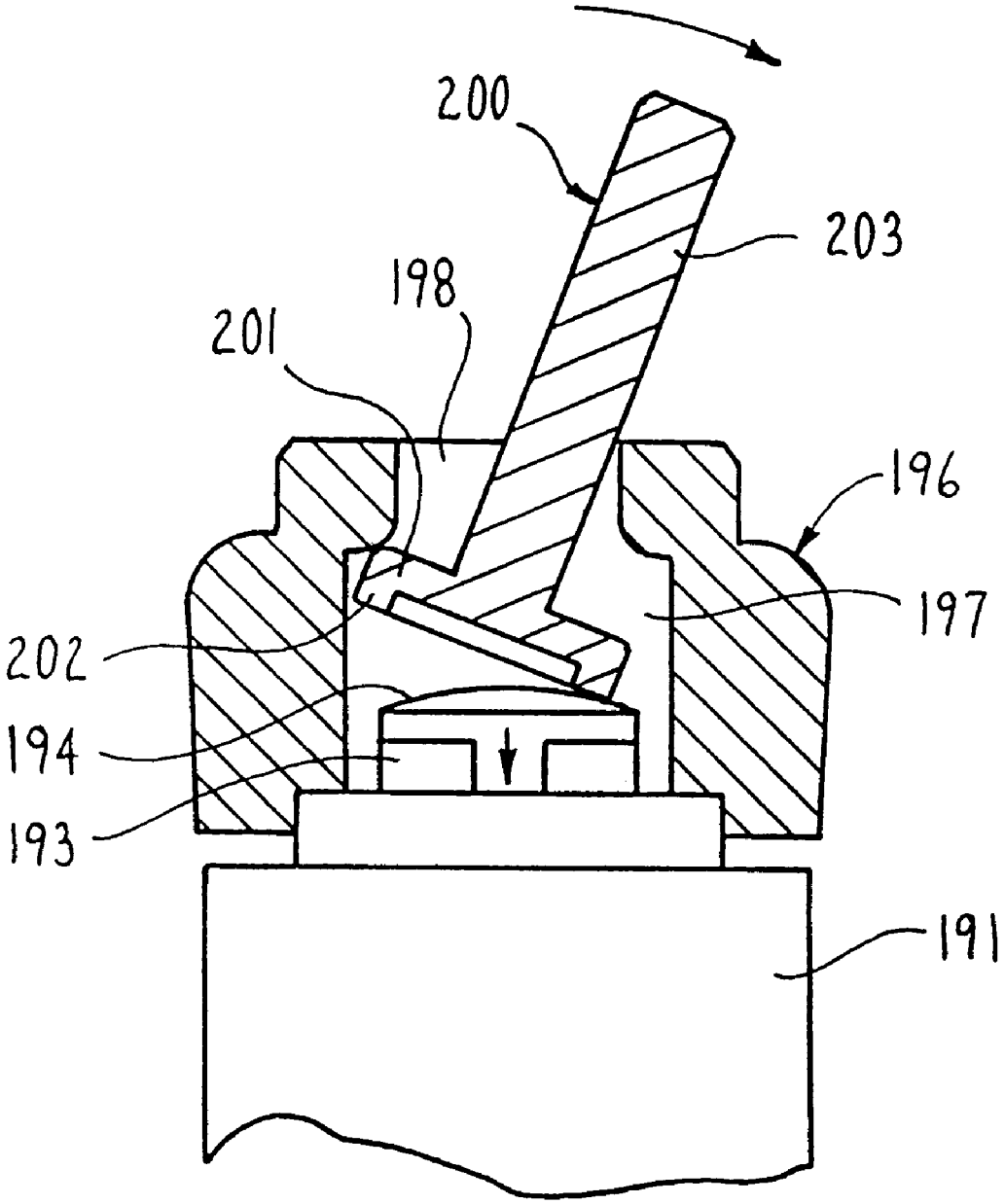
FIG. 25 is a partial front cross sectional view of the pneumatic actuator mechanism after being actuated.

The pin 200 also includes a vertically elongate shaft 203 extending upwardly from the head 201. The shaft 203 extends vertically through the passage 198 of the shroud 196 and out of the pedestal mounting bracket 35-1. As seen in FIG. 25, the pin 200 is able to be pivoted in any sideward direction, and when pivoted, one side of the head 201 contacts the shroud 196 so as to define a pivot point. The side of the head 201 opposite the pivot point then swings downwardly against the button 193 to depress the button 193 and actuate the valve 20-1 for adjusting the chair height.

Since the bottom 193, shroud 196, passage 198, head 201 and shaft 203 are circular when viewed from above, the pin 200 can actuate the button 193 when the pin 200 is tilted in any sideward or horizontal direction. Thus, while the pin 200, as described herein, is tilted forwardly during use, the pin 200 can also be actuated in any other direction including rearwardly and sidewardly without modifying the arrangement of the pin 200 and shroud 196.

To actuate the pin 200, the actuator lever 62-1 is connected to the top of the pedestal mounting bracket 35-1 and is pivotable forwardly. More particularly, one end of the lever 62-1 is pivotally connected to the bracket 35-1 by a pivot screw 206 (FIGS. 21 and 22). An intermediate section of the lever 62-1 includes an opening 207 through which the pin shaft 203 is received, and the free end thereof includes a cable bracket 208.

As seen in FIG. 22, a coaxial cable 209 is connected to the cable bracket 208 so as to pull or pivot the free end of the lever 62-1 forwardly. When the lever 62-1 is pulled forwardly, the pin 200 is tilted as seen in FIG. 25 for adjusting the chair height.

To secure the cable 209 to the lever 62-1, an interior cable 210 of the coaxial cable 209 connects to the cable bracket 208 so as to move therewith while the cable sheath 211 is connected to a stationary U-shaped bracket 212 on the control housing 34-1.

The opposite end of the cable 209 connects to the seat support frame 25-1 as seen in FIG. 26. The interior cable 210 also is connected to a manual actuator mechanism 214 which mounts to the seat support frame 25-1 as seen in FIG. 27 by fasteners.

Figure 26A:
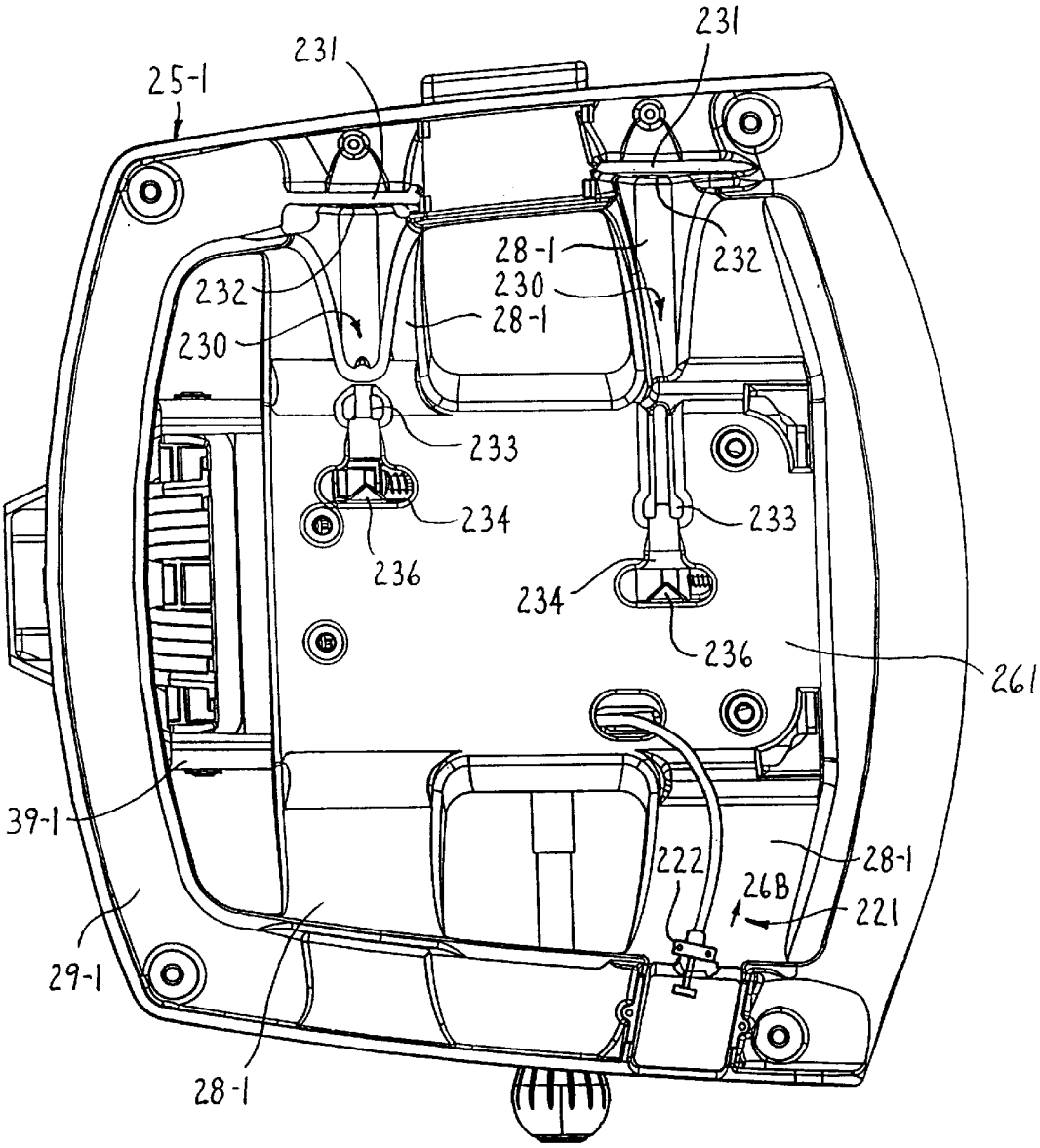
FIG. 26A a top plan view of a seat assembly of the invention.
Figure 26B:
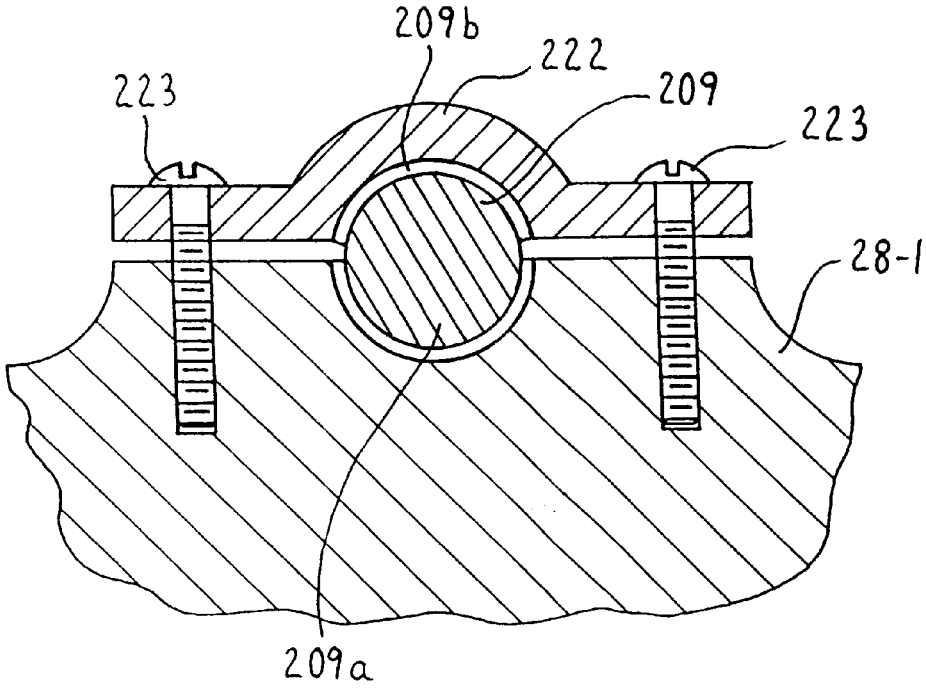
FIG. 26B is a cross sectional view of a cable adjustment assembly as viewed in the direction of arrows 26B—26B of FIG. 26A.
Figure 26C:
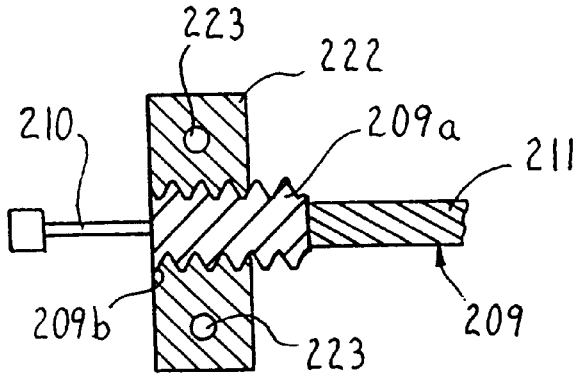
FIG. 26C is a partial top plan view in cross section of the cable adjustment assembly of FIG. 26B.

Referring to FIGS. 26A, 26B and 26C, the cable 209 is adjusted by an adjustment assembly 221 on the support frame 25-1. The adjustment assembly 221 includes a bracket 222 overlying the cable 209 proximate the actuator mechanism 214, and a pair of screws 223 threadedly engaged with the frame 25-1. Further, the cable 209 includes a threaded collar 209*a* which includes threads 209*b* that cooperate with corresponding threads or grooves on the bracket 222. The collar 209*a* can be repositioned farther into or out of the bracket 222 to adjust the end position of the cable 209 to permit fine adjustment of the cable 209 and accommodate variations in the length of the cable 209. For example, the collar 209*a* can be longitudinally toward the bracket 22 for a longer cable 209.

With this arrangement, the pneumatic actuator mechanism 170 is readily usable to raise and lower the seat height, while at the same time being readily modifiable to permit the actuator pin 200 to be tilted from any sideward direction.

Figure 27:
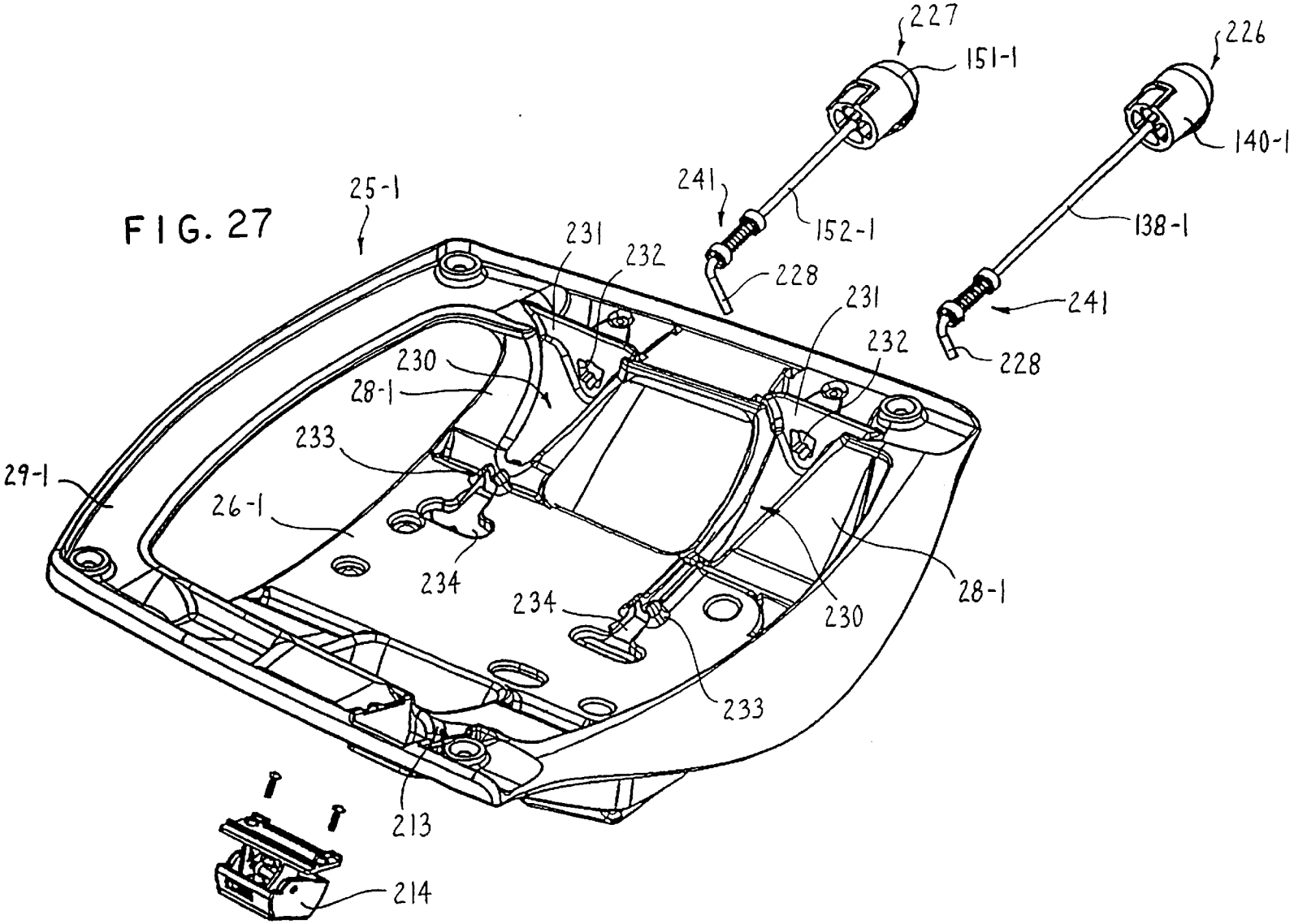
FIG. 27 is an exploded perspective view of the seat assembly.
Figure 30:
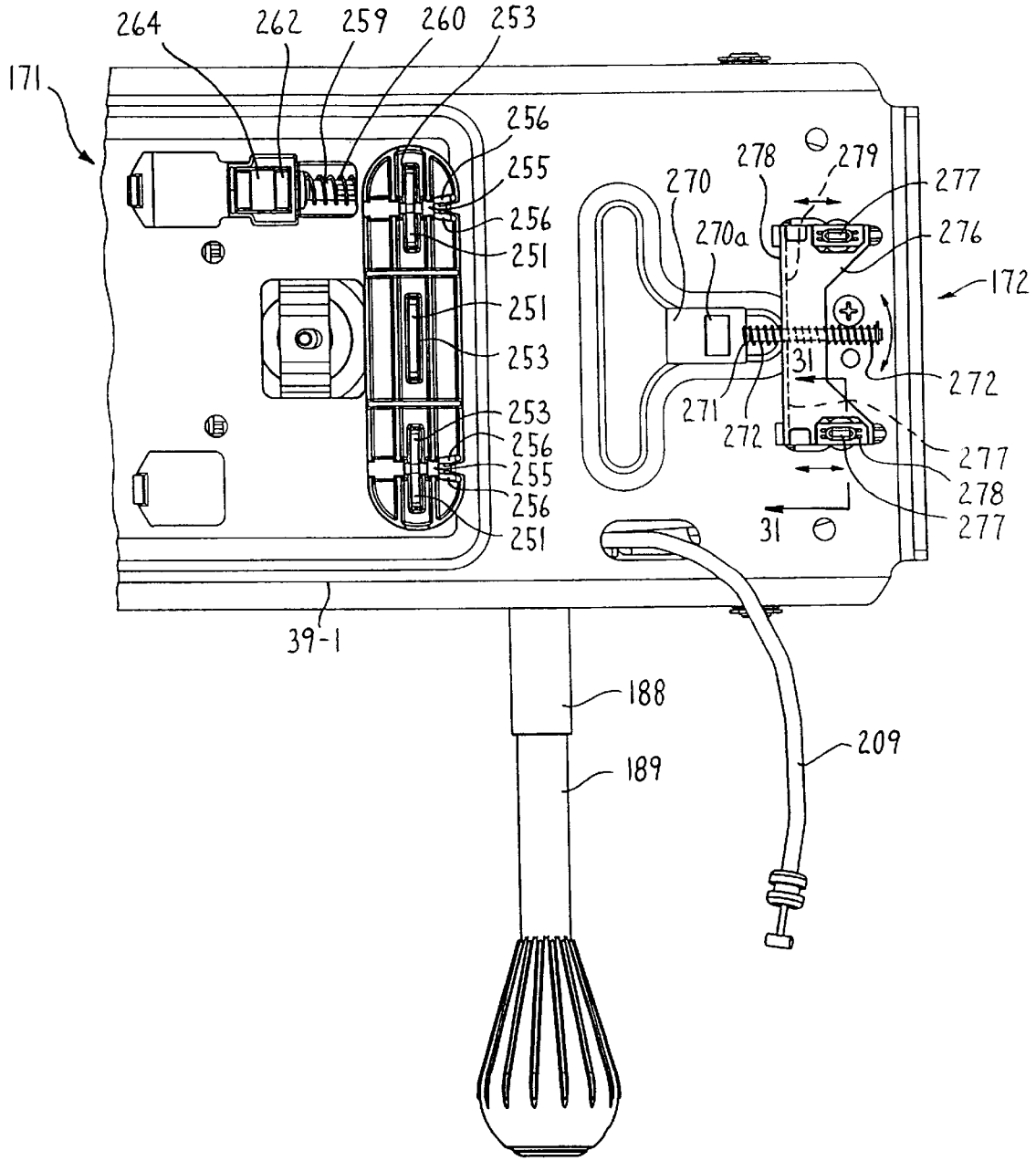
FIG. 30 is a partial top plan view of the tilt control mechanism.
Figure 31:
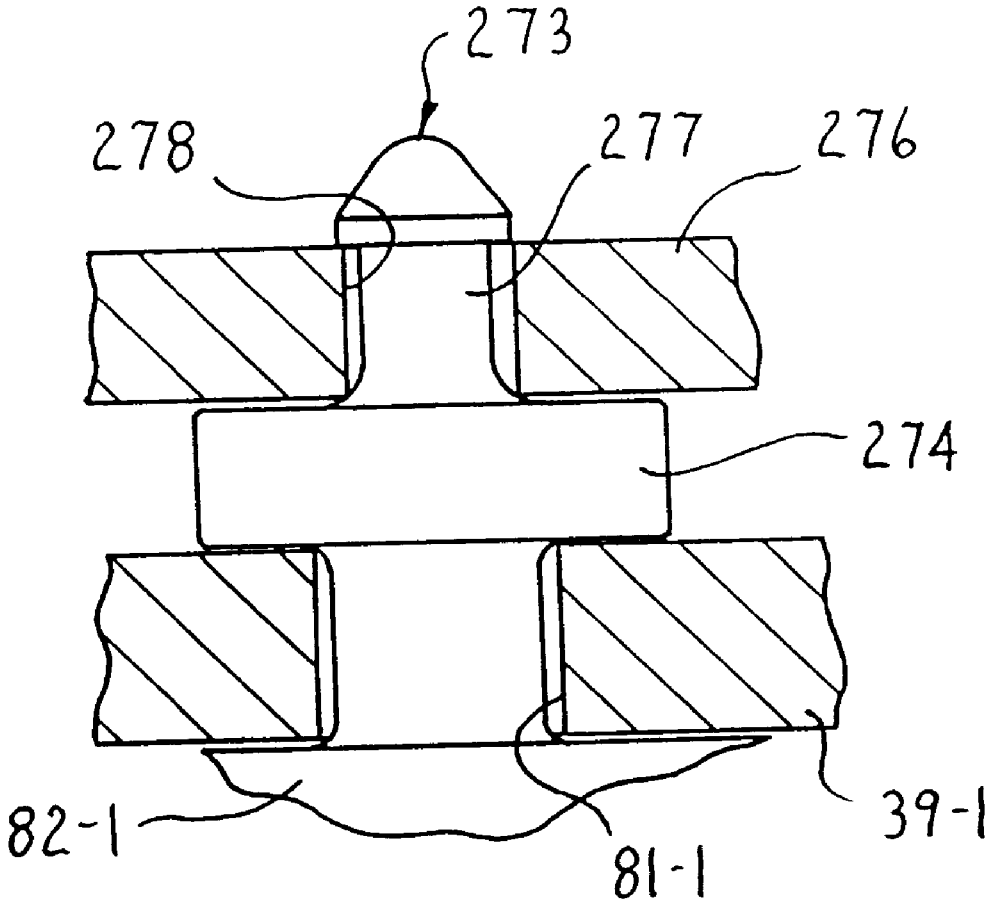
FIG. 31 is a front cross sectional view of the mounting for the front tilt lock plate as viewed in the direction of crows 31—31 of FIG. 30.

Referring to FIGS. 21, 26A and 27, the tilt control mechanism 14-1 further includes the rear lock actuator mechanism 171 and the front lock actuator mechanism 172 which generally mount to the top plate 39-1 as seen in FIG. 30. Before discussing the specific construction of these lock mechanisms 171 and 172, the following discussion relates to the front and rear actuator handles 227 and 226 for the lock mechanisms 171 and 172 respectively which are movable between two positions for actuating these lock mechanisms.

In particular, the actuator handles 226 and 227 respectively include front and rear locking knobs 140-1 and 151-1 which are connected to the outer ends of front and rear rods 138-1 and 152-1. The actuator handles 226 and 227 are substantially identical except that the front rod 138-1 is longer than the rear rod 152-1. Each of these rods is bent at the inner free end thereof to define a radial projection 228 having a predetermined length to engage with the interior components of the front and rear lock mechanisms 172 and 171 as will be described herein. The length of the radial projection 228 can also be varied where necessary.

To mount the actuator handles 226 and 227 to the chair, the left side support arms 28-1 of the seat support frame 25-1 have horizontally elongate channels 230 that permit the rods 138-1 and 152-1 to pass therethrough. In particular, each support arm 28-1 includes an outer wall 231 at an outer end thereof which has an aperture 232 therethrough. The aperture 232 rotatably supports the outer end of the respective rod 138-1 or 152-1 therein.

The center mounting structure 26-1 of the support frame 25-1 also includes U-shaped support brackets 233 which extend upwardly therefrom and rotatably support the inner ends of the respective rod 138-1 or 152-1. With this arrangement, the rods are supported on the support frame 25-1.

Figure 28:
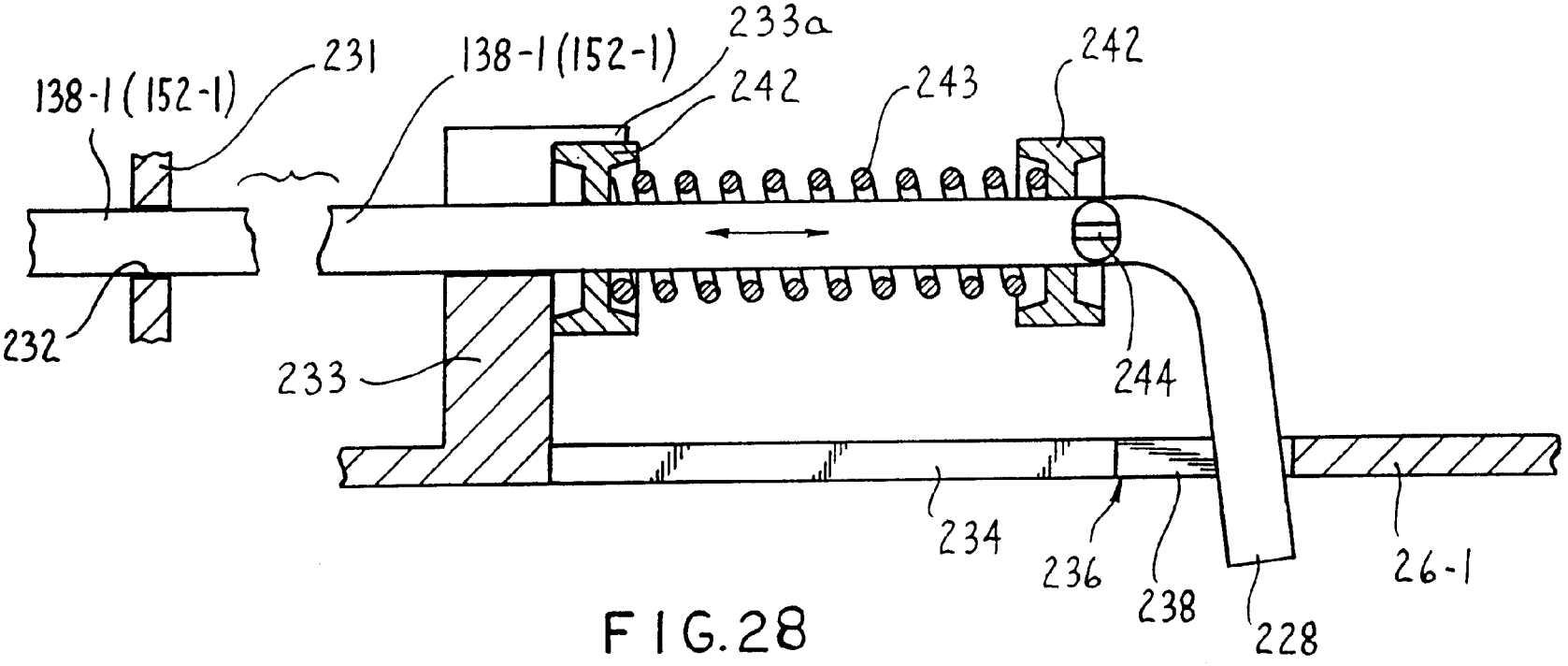
FIG. 28 is a partial side elevational view in cross section of an actuator handle.
Figure 29:
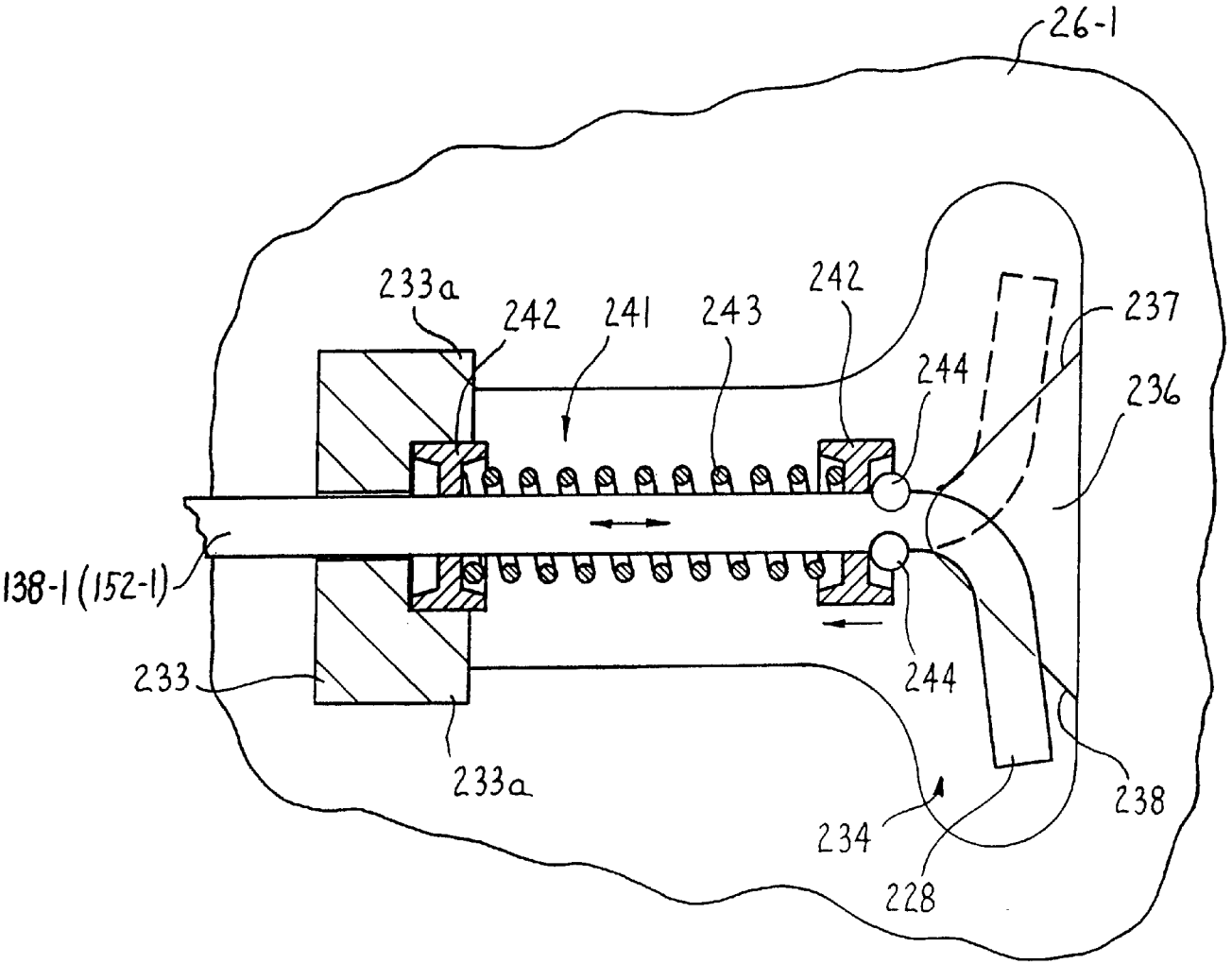
FIG. 29 is a partial top plan view of the actuator handle in cross section.

To connect the rods 138-1 and 152-1 to the respective lock mechanisms 172 and 171, a T-shaped vertical passage or port 234 is provided immediately adjacent to the inner support brackets 233. As seen in FIGS. 28 and 29, the radial projections 228 project downwardly through the ports 234 into engagement with the internal components of the lock mechanisms 172 and 171 respectively.

To define two engagement positions (as seen in solid outline and phantom outline in FIG. 29), for example, locked and unlocked positions for the actuator handles 226 and 227, each port 234 includes a generally V-shaped ramp 236 on the inner edge thereof. Each side 237 and 238 of the ramp 236 defines a position for the actuator handles 226 and 227. Thus, upon rotation of the handles 226 and 227, the respective radial projection 228 slides up and over the apex of the ramp 236 between engaged and disengaged positions. Preferably, the apex of the V-shaped ramp 236 is rounded to minimize wear during sliding of the radial projection 228.

To permit this sliding over the ramp 236, each rod 138-1 and 152-1 is axially or longitudinally movable relative to the support frame 25-1. However, each handle 226 and 227 also includes biasing means 241 which resists this axial movement and tends to bias the rods axially toward the engaged or disengaged positions on the opposite sides of the apex.

As seen in FIG. 27–29, the biasing means 241 comprises a pair of annular collars 242 slidably positioned on the rods, and a coil spring 243 disposed between the collars 242. Each rod includes a pair of pinched projections 244 near the radial projections 228 and the innermost collar abuts against these projections 244. The outer collar 242, however, is unrestrained on the rod 138-1 or 152-1.

When the rods 138-1 and 152-1 are mounted in position, the spring 243 is in compression and the collars 242 act in opposite axial directions against the support bracket 233 and the projections 244. The support bracket 233 also includes a rim or lip 233*a* which defines a sidewardly opening seat for the collar 242. The rim 233a prevents the collar from move sidewardly or vertically relative to the bracket 233 to prevent the collar 242 from sliding off the bracket 233.

The rod, however, is axially movable relative to the support bracket 233 so that the radial projection 228 can slide up and over the ramp 236 but is normally biased to one of the operative positions. With this arrangement, the actuator handles 226 and 227 can be snapped or moved between one of the two positions by rotation of the knobs 140-1 and 151-1.

Figure 32:
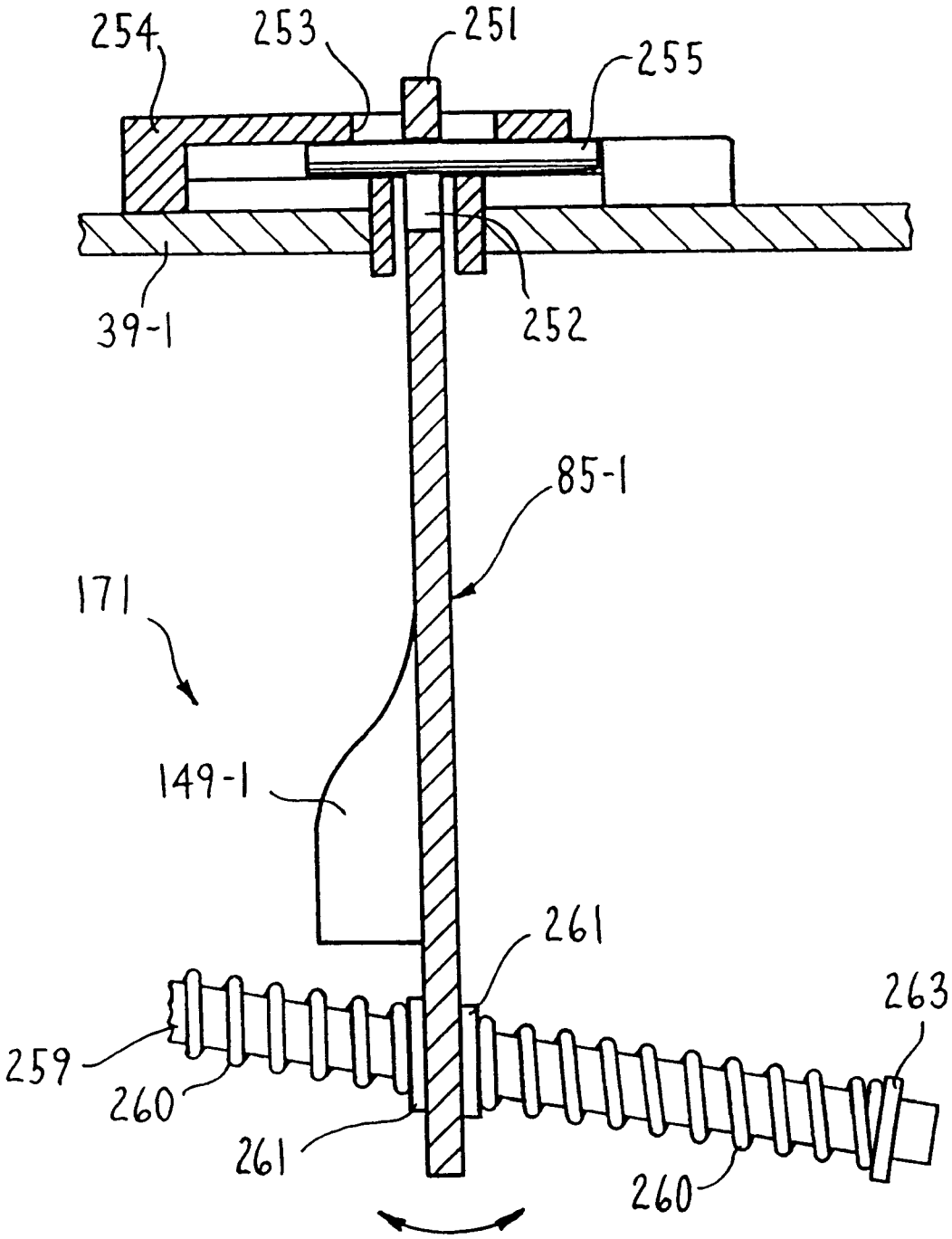
FIG. 32 is a right side elevational view in cross section of the rear lock actuator mechanism.

More specifically with respect to the rear lock mechanism 171 as seen in FIGS. 21, 30 and 32, this mechanism includes the rear lock plate 85-1 which functions substantially the same as the lock plate 85 previously described herein. However, the lock plate 85-1 is mounted to the top plate 39-1 in an improved manner.

The lock plate includes three tabs 251 on the upper edge thereof which project vertically through the corresponding slots 81-1 formed in the top plate 39-1. Two of the tabs 251 include bores 252 extending horizontally therethrough.

The tabs 251 also project vertically through corresponding slots 253 in a plastic isolator 254 (FIGS. 21, 30, 32) which lays on top of the top plate 39-1. The isolator 254 is formed so as to permit pins 255 to be inserted sidewardly through the exposed bores 252 of the tabs 251 and into a corresponding bore in the isolator 254. The isolator 254 also includes resilient plastic fingers 256 which snap over the end of each pin 255 after insertion to prevent the pins 255 from being dislodged.

The pins 255 thereby secure the lock plate 85-1 to the isolator 254. The pins 255 are dimensioned smaller than the bores 252 in the tabs 251 so that forward and rearward rocking of the lock plate 85-1 can occur. Since the isolator 254 is plastic, metal to metal contact is minimized which results in a quieter, smoother acting mechanism.

To actuate the lock plate 85-1, the lock plate 85-1 includes a slot 258 (FIGS. 21 and 32) through which a rod 259 extends. Two separate springs 260 and two washers 261 are provided on the opposite sides of the lock plate 85-1 and a drive block 262 is connected to the rod 259 at one end thereof. The springs 260 are retained on the rod 259 by a retainer 263.

As seen in FIG. 30, the drive block 262 is slidably supported on the top of the top plate 39-1. The drive block 262 also includes a recess 264 on the top thereof which receives the above-described radial projection 228 of the rear actuator handle 227. Thus, movement of the handle 227 between the engaged and disengaged positions moves the drive block 262 forwardly and rearwardly which causes one or the other of the springs 260 to bias the lock plate 85-1 forwardly or rearwardly.

Due to the spring connection, if the lock plate 85-1 is temporarily bound or prevented from pivoting, the springs 260 permit the actuator handle 227 to move completely to one of its engagement positions, and the lock plate 85-1 would eventually shift to its locked or unlocked position once any interference has been removed such as by normal forward or rearward tilting of the chair by the occupant.

In the front lock actuator mechanism 172, a similar arrangement is used in that a slidable drive block 270 is provided which includes a top recess 270*a* connected to the front actuator handle 226 for forward and rearward movement of the drive block 270. The drive block 270 moves a rod 271 extending forwardly therefrom, and a pair of springs 272 are slid and retained on the rod 271.

As described previously and as seen in more detail in FIGS. 30–31, the front tilt-lock plate 82-1 includes two projections 273 which project upwardly therefrom and extend through corresponding key-shaped slots 81-1 in the top plate 39-1. These projections 273 have a circular, large-diameter section 274 but are still slidable forwardly and rearwardly along the narrow portions of the key-shaped slots 81-1.

To move the tilt-lock plate 82-1, a plastic carrier 276 is connected to these projections 273 on the top of the top plate 39-1. In particular, the projections 273 have an oval section 277 projecting upwardly from the large-diameter section 274 which snaps into corresponding openings 278 in the carrier 276 so that the carrier 276 and the lock plate 82-1 move together.

The carrier 276 further includes a downwardly depending rear wall 277 which is formed with a horizontal aperture for the rod 271. The springs 272 act on the opposite side surfaces 278 and 279 of the rear wall 277 and push the carrier 276 forwardly or rearwardly.

The connection of the springs 272 to the carrier 276 preferably has sufficient clearance and play so as to permit the carrier 276 and tilt-lock plate 82-1 to rotate or twist relative thereto as indicated by the arrow in FIG. 30. Preferably, the slots 81-1 and projections 273 also have additional clearance so as to permit this twisting. As a result, if the tilt-lock plate 82-1 binds or catches on one end thereof, the plate 82-1 can still twist so as to permit a portion of the plate 82-1 to be moved to its locked or unlocked position. Upon the removal of the interference such as by normal movement of the chair, the carrier 276 would self-center or realign itself.

As discussed herein, the tilt control mechanism 14-1 operates substantially the same as the tilt control mechanism 14 but includes additional improvements therein.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In a chair having a height-adjustable base and a seat assembly supported on said base, said height-adjustable base including a pneumatic cylinder for raising and lowering said seat assembly, an axially-movable valve for controlling said pneumatic cylinder, and an actuator for said valve, comprising the improvement wherein said actuator includes a housing which encloses an end of said valve and defines a chamber therein, said housing including a housing opening therethrough to permit access to said chamber, said actuator further including an actuator pin it having a disc-like head disposed in said chamber and a shaft projecting axially from said head through said housing opening, a lower surface of said head being in contacting relation with said axially-movable valve and an upper surface of said head being in contact with an interior surface of said housing, said actuator further including a pin control mechanism for moving said shaft in a direction transverse to said axial direction to effect tilting of said head such that one side of said head contacts said interior surface and defines a pivot axis for tilting of said head while an opposite side of said head contacts said valve to effect axial displacement of said valve.

2. A chair according to claim 1, wherein said head includes an annular rim projecting axially from said lower surface of said head.

3. A chair according to claim 1, wherein said head has an annular periphery so as to effect movement of said valve during tilting of said shaft in a plurality of transverse directions.

4. A chair according to claim 1, wherein said pin control mechanism includes a lever pivotally connected to said seat assembly so as to be pivotable about a generally axial pivot axis, said pivot lever including an aperture through which said shaft of said pin extends axially.

5. A chair according to claim 4, wherein said tilt control mechanism includes a control cable connected to a free end of said lever, said control cable being manually actuatable to effect pivoting of said lever.

6. A chair according to claim 5, wherein said cable comprises an outer sheath and an interior coaxial cable which is slidably received within said sheath and connected to said lever, an inner end of said sheath being connected to said chair assembly proximate said lever and an outer end of said sheath being connected to said seat assembly proximate a manually-actuatable button part, said button part being connected to said interior cable so as to effect pivoting of said lever, said outer end of said sheath including parallel threads on an outer end thereof which are received within a clamp disposed on said seat assembly, said clamp including grooves corresponding to said threads and being releasable to permit adjustment of the position of said grooves within said clamp and being engageable to secure said outer sheath in an adjusted position.

7. A chair according to claim 5, wherein said lever swings generally in said transverse direction.

8. In a chair having a height-adjustable base and a seat assembly supported on said base, said height-adjustable base including a lift unit for raising and lowering said seat assembly, a control button which is movable in a first direction for controlling said lift unit, and an actuator for moving said control button, comprising the improvement wherein said actuator includes a housing which defines a stop surface spaced away from said control button in said first direction, said actuator further including an actuator pin that has an enlarged head having a thickness defined by opposite inner and outer faces and has an elongate projection which projects from one of said faces of said head, said head being disposed between said control button and said stop surface wherein said projection projects generally in said first direction away from said control button, said inner face of said head being operatively connected with said control button and said outer face of said head abutting against said stop surface, said actuator further including a pin control mechanism connected to said projection thereof which moves said projection in a second direction transverse to said first direction to effect tilting of said head such that one edge portion of said head contacts said stop surface and defines a pivot axis for tilting of said head while an opposite edge portion of said head moves toward said control button to move said control button in said first direction.

9. The chair according to claim 8, wherein said pin control mechanism includes a lever which is pivotable about a rotation axis wherein said lever is movable generally in said second direction, said lever being connected to said projection of said pin for movement of said pin in said second direction.

10. The chair according to claim 9, wherein said pin control mechanism includes a control cable which is connected to said lever to effect movement thereof in said second direction and permit raising and lowering of said seat assembly.

11. A chair according to claim 10, wherein said lift unit is a pneumatic cylinder having one end connected to said base and a second end connected to said seat assembly.

12. A chair according to claim 8, wherein said inner face of said head abuts against an opposing upper surface of said control button, said first direction extending vertically wherein said control button is vertically movable.

13. A chair according to claim 12, wherein said head projects sidewardly from opposite sides of an outer surface of said projection to define said first and second edge portions.

14. A chair according to claim 13, wherein said housing includes an end wall which defines said stop surface on an interior side thereof and has an opening which opens therethrough in said first direction to permit said projection to project outwardly from said housing for connection to said pin control mechanism.

15. A chair according to claim 8, wherein said lift unit is disposed within a spindle of said base and said control button is disposed at an upper end of said lift unit, said seat assembly including a support body rigidly connected to said spindle and said housing of said actuator being disposed within said support body.

16. In a chair having first and second chair components and an extendable pneumatic cylinder connected to said first and second chair components to control movement of said first and second chair components toward and away from each other, said pneumatic cylinder including a control button which is movable in a first direction to control said pneumatic cylinder, said chair further including an actuator arrangement connected to said control button having a handle which is accessible from an exterior of said chair for effecting movement of said control button, comprising the improvement wherein said actuator includes a housing disposed adjacent to said control button which said housing defines a stop surface that is spaced away from said control button in said first direction, said actuator including an actuator pin having an elongate shaft wherein an outer end of said shaft projects from said housing in said first direction, said pin including a head which is connected to one end of said shaft and projects sidewardly from said shaft to define opposite first and second edge portions, said head being disposed between said control button and said stop surface wherein said first edge portion defines a pivot axis about which said head tilts in response to movement of said outer end of said shaft in a second direction, said second direction being oriented transverse to said first direction, wherein said second edge portion is movable in said first direction toward said control button in response to tilting of said head about said pivot axis, said handle being connected to said free end of said shaft for moving said shaft in said second direction.

17. A chair according to claim 16, wherein said housing is supported on an end of said pneumatic cylinder and has an interior chamber which is open on one side to receive said control button therein, said head being confined within said chamber between said stop surface and said control button.

18. A chair according to claim 17, wherein said housing includes an end wall which closes an opposite side of said chamber but includes an opening which permits said outer end of said shaft to project through said end wall.

19. A chair according to claim 16, wherein said first chair component is a chair base and said second chair component is a seat assembly.

* * * * *